US005496689A

United States Patent [19]

Ogawa

[11] Patent Number: 5,496,689

[45] **Date of Patent: *Mar. 5, 1996**

[54] SILVER HALIDE COLOR PHOTOGRAPHIC MATERIALS

[75] Inventor: Tadashi Ogawa, Kanagawa, Japan

[73] Assignee: Fuji Photo Film Co., Ltd., Kanagawa, Japan

[ * ] Notice: The term of this patent shall not extend beyond the expiration date of Pat. No. 5,057,405.

[21] Appl. No.: 376,451

[22] Filed: Jan. 23, 1995

Related U.S. Application Data

[63] Continuation of Ser. No. 80,591, Jun. 24, 1993, abandoned, which is a continuation of Ser. No. 574,161, Aug. 29, 1990, abandoned.

[30] Foreign Application Priority Data

Aug. 29, 1989 [JP] Japan ..... 1-222015

[51] Int. Cl.[6] ..... G03C 1/035; G03C 1/12; G03C 1/46

[52] U.S. Cl. ..... 430/505; 430/508; 430/567; 430/584; 430/592; 430/595; 430/605; 430/944

[58] Field of Search ..... 430/505, 506, 430/508, 567, 584, 592, 595, 605, 944

[56] References Cited

U.S. PATENT DOCUMENTS

| | | | |
|---|---|---|---|
| 4,619,892 | 10/1986 | Simpson et al. | 430/508 |
| 4,705,745 | 11/1987 | Kitchin et al. | 430/508 |
| 4,717,650 | 1/1988 | Ikeda et al. | 430/494 |
| 4,894,319 | 1/1990 | Ikeda et al. | 430/567 |
| 4,956,702 | 9/1990 | McQuade et al. | 430/944 |
| 5,057,405 | 10/1991 | Shiba et al. | 430/505 |
| 5,108,872 | 4/1992 | Inoue et al. | 430/567 |
| 5,126,235 | 6/1992 | Hioki | 430/505 |

*Primary Examiner*—Janet C. Baxter
*Attorney, Agent, or Firm*—Sughrue, Mion, Zinn, Macpeak & Seas

[57] ABSTRACT

A silver halide color photographic material comprising:

(a) a support, (b) at least three silver halide photosensitive emulsion layers on said support, where (i) each of said at least three photosensitive layers has spectral sensitivity peaks in three different light wavelength regions of not smaller than 650 nm, and (ii) said the photosensitive layer contains a cyan coupler, the other photosensitive layer contains a magenta coupler and the another photosensitive layer contains a yellow coupler, and (c) silver halide of said at least three photosensitive emulsion layers comprises silver chloride or silver chlorobromide containing at least 96 mol% silver chloride, where grains of silver halide of at least one of said three layers further contain from 0.01 to 3 mol% of silver iodide (based on the amount of silver halide in the emulsion) on the grain surface or sub-surface.

7 Claims, 1 Drawing Sheet

SILVER HALIDE COLOR PHOTOGRAPHIC MATERIALS

This is a continuation of application No. 08/080,591 filed Jun. 24, 1993, now abandoned, which is a continuation application of 07/574,161 filed Aug. 29, 1990, now abandoned.

FIELD OF THE INVENTION

This invention concerns silver halide color photographic materials and a method of forming color images and, more precisely, it concerns silver halide color photographic materials which have a high photographic speed, are stable and are spectrally sensitized for use with laser scanning exposure, and a method of forming color images using rapid exposure and processing methods.

BACKGROUND OF THE INVENTION

The accumulation and output of information including pictures and the output of this information to a display or as a hard copy has come to be widely used in recent years.

In the past, techniques for the production of hard copy from soft information have included non-photosensitive recording materials, such as ones using electrical signals, magnetic signals or ink jet systems, and photosensitive materials, for example silver halide photosensitive materials or electrophotographic materials.

In the case of the method using photographic materials, recordings are made using an optical system that emits light in accordance with the image information. This enables not only the optical system itself, image resolution and multi-level recording, but also multi-tone recording to be achieved. Such systems are useful for obtaining high image quality. Because image formation is carried out chemically with the silver halide photographic materials the image quality is higher than systems in which electrophotographic materials are used and greater amounts of information are recorded.

Because image formation with silver halide photographic materials requires wet processing, electrophotographic recording materials are generally favored in fields where the quality requirements are not high.

Recently, progress has been made with photographic image forming systems in which silver halide color photographic materials and compact, simple, rapid development systems are used. Such systems now make it possible to supply photographic prints of very high image quality comparatively easily and cheaply. Using such a system is used to obtain images from soft information permits high image quality hard copy to be supplied easily and cheaply.

Special means are required to carry out the rapid and simple development processing of such silver halide color photographic materials. The silver halide color photographic material must combine adequate performance of its photosensitive wavelengths, optimum speed and color separation for matching the optical system which is being used and the application, and it must also have a photographic speed which is adequately stable.

In the past, color copying techniques include copying machines and laser printers using electrophotographic techniques, and a combination of LED, silver halide based heat development and dye diffusion systems. Silver halide color photographic materials comprising a support having established thereon at least three silver halide emulsion layers in which conventional color couplers are used and in which at least two layers are spectrally sensitized with dyes to laser light in the infrared region are disclosed in JP-A-61-137149. (The term "JP-A" as used herein signifies an "unexamined published Japanese patent application".)

JP-A-63-197947 describes full color recording materials of at least three photosensitive layers containing color couplers. At least one of these layers is photosensitive to LED or semiconductor laser light, and is spectrally sensitized so that the spectrally sensitized peak wavelength is longer that about 670 nm. Colored images are obtained by means of a scanning exposure with subsequent development processing. The method describes spectral sensitization which is stable and provides high speed, and provides a method of using dyes.

A color photographic material image recording system wherein yellow, magenta, and cyan color formation is controlled with three light beams of different wavelengths, for example green, red and infrared light beams, respectively, is disclosed in JP-A-55-13505.

A continuous tone scanning type printer which has a semiconductor laser output controlling mechanism is described by S. H. Baek on pages 245–247 of the published papers of the *Fourth International Symposium on Non-impact Printing* (SPSE).

A method of using silver halide color photographic materials to produce hard copy from soft information generally provides high image quality in a stable manner more readily than a non-photosensitive recording method or a method in which electrophotographic materials are used. If semiconductor lasers are used for a scanning exposure system then, an exposing apparatus can be made that is compact and inexpensive.

However, the wavelength of usable semiconductor lasers cannot, at the present time, be selected arbitrarily. Most recently, lasers of wavelength in the vicinity of 670 nm have become available. Many practical lasers already exist that produce light in the infrared wavelengths.

At least three photosensitive layers that are spectrally sensitized to different photosensitive wavelength regions are required in a subtractive color photographic system such as the present invention. At least one or two of these layers and, depending on the particular case, three or more of these layers must be photosensitive to the infrared wavelength region.

The drawback of semiconductor lasers is that output of elements in the shorter wavelength region of the visible region or infrared region close to the visible region is not very large and it is difficult to obtain stable output.

Thus, the characteristics required of a photosensitive material for use with semiconductor lasers of this type are high photographic speed, stable performance regardless of fluctuations of the wavelength and other characteristics of the semiconductor laser and the realization of these features within the light wavelength range of the infrared region. It is difficult to satisfy these requirements in the infrared region using just silver iodobromides which are generally useful for obtaining high photographic speeds.

On the other hand, if a color image is to be obtained from an exposed photographic material using a system of this type then silver iodobromide has an adverse effect on the rapidity of the process and it is well known that silver chlorobromide is preferred. It is also well known in these circumstances, in particular, that so-called high silver chloride emulsions which contain a high proportion of silver chloride are preferred.

However, it is difficult to satisfy the aforementioned requirements in the infrared region with such a high silver chloride emulsion. That is to say, silver chloride emulsions are not advantageous for spectral sensitization with infrared spectrally sensitizing dyes. This makes it difficult to achieve high photographic speed and stable photographic speed with respect to various exposure conditions using silver chloride emulsions.

SUMMARY OF THE INVENTION

The aim of the present invention is to resolve the technical problems involved in providing high speed stable emulsions that use high silver chloride which is useful useful to achieve rapid processing properties. In other words, the problem to be resolved is to provide high speed, stable emulsions with little loss of the rapid processing properties of high silver chloride emulsions. The aim of the present invention is to provide a means of resolving this problem. This aim has been realized by means of the following silver halide color photographic materials and the method of using them for color image formation.

A silver halide color photographic material comprising:

(a) a support, (b) at least three silver halide photosensiive emulsion layers on said support, where (i) each of said at least three photosensitive layers has spectral sensitivity peaks in three different light wavelength regions of not smaller than 650 nm, and (ii) said the photosensitive layer contains a cyan coupler, the other photosensitive layer contains a magenta coupler and the another photosensitive layer contains a yellow coupler, and (c) silver halide of said at least three photosensitive emulsion layers comprises silver chloride or silver chlorobromide containing at least 96 mol% of silver chloride, where grains of silver halide of at least one of said at least three layers further contain 0.01 to 3 mol% of silver iodide (based on the amount of silver halide in the emulsion) on grain surfaces or sub-surfaces.

In a preferred silver halide color photographic material of the present invention, photosensitive wavelength regions of the three photosensitive emulsion layers have spectral sensitivity peaks in the ranges of 650–690 nm, 720–790 nm and 770–850 nm, respectively.

In another preferred silver halide color photographic material of the present invention, the silver halide in the photosensitive layer which has a spectral sensitivity peak in the longest wavelength is silver chloride or silver chlorobromide grains further containing from 0.01 to 3 mol% of silver iodide on the grain surface or sub-surface.

In another preferred silver halide color photographic material of the present invention, silver chloride or silver chlorobromide grains in all three photosensitive emulsion layers contain from 0.01 to 3 mol% of silver iodide on the grain surface or sub-surface.

A method that satisfies these aims is a method for forming a color image comprising the steps of:

(1) exposing the silver halide photographic material described above with a scanning exposure at an average exposure time per picture element of $10^{-3}$ seconds or less using a plurality of laser light sources, said laser light sources having emission wavelength within the three different light regions, respectively; and (2) within 40 seconds after said exposing, processing said material with a color developer for a color development time of 60 seconds or less, for a total processing time not including drying of 180 seconds or less, and drying time of 60 seconds or less.

A preferred method of the present invention is a method, where step (1) comprises exposing a silver halide photographic material to a scanning exposure at an average exposure time per picture element of $10^{-4}$ seconds or less; and said step (2) comprises within 20 seconds after said exposing, processing said material with a color developer for a color development time of 20 seconds or less, for a total processing time not including drying of 90 seconds or less, and a drying time of 30 seconds or less.

An additional preferred method of the present invention is a method at least one of color development processing and bleach fix processing is conducted using a discarding system without carrying out replenishment.

DETAILED DESCRIPTION OF THE INVENTION

Figure 1:
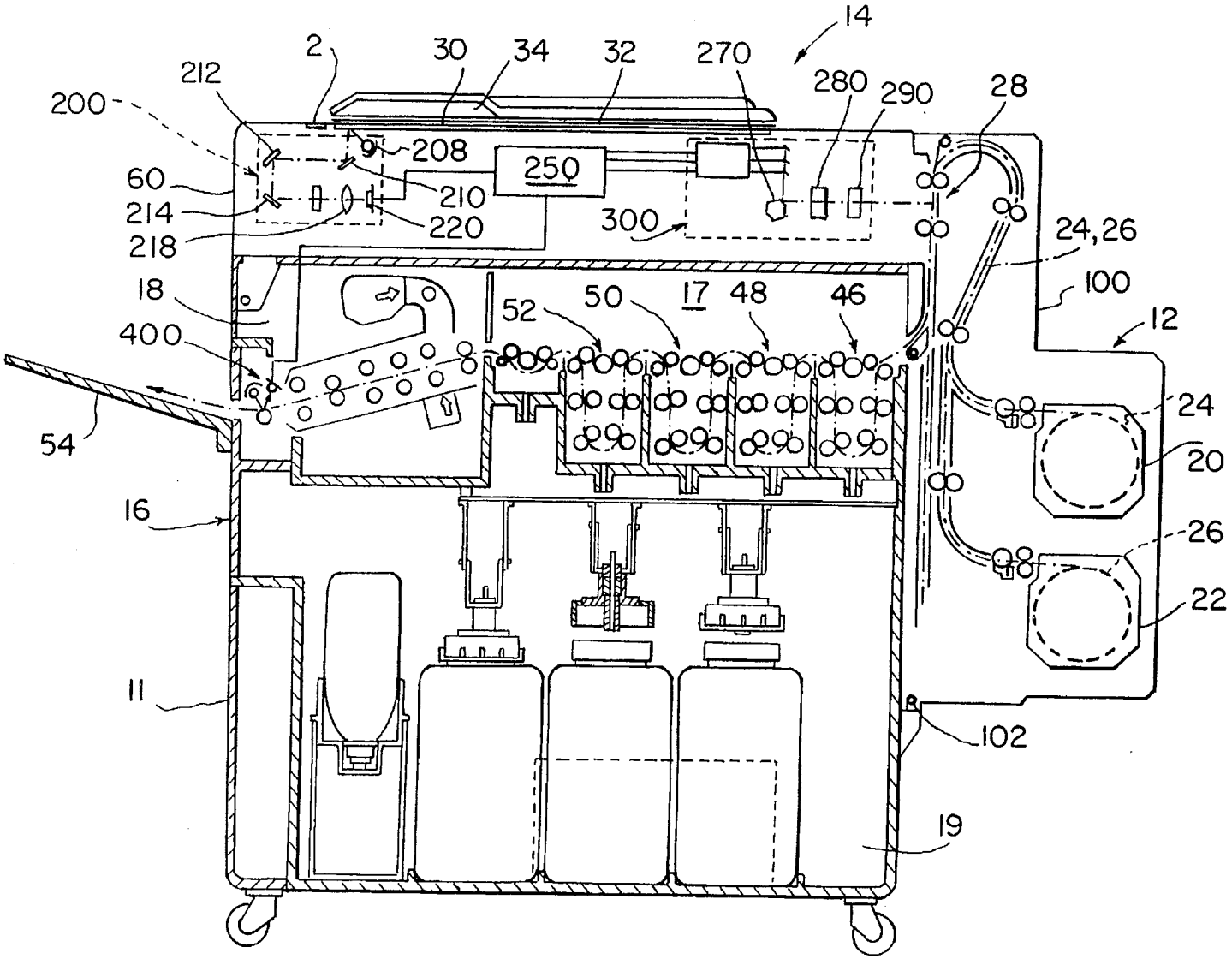
FIG. 1 is outline cross-section of a rapid exposure and processing machine that uses the material and method of the present invention.

The silver halide emulsions used in the photosensitive layers of a silver halide color photographic material of the present invention contain silver chloride or silver chlorobromide containing at least 96 mol% of silver chloride. The silver chlorobromide grains or silver chloride grains in at least one of the photosensitive layers further have silver iodide in an amount of from 0.01 to 3 mol% of silver iodide in the grain surface or sub-surface.

In the present invention, the grain sub-surface signifies a region from the surface which comprises the outermost atoms of the crystal grain to a few tens of atomic layers. Hereinafter, the grain surface and sub-surface are referred to collectively as the grain surface.

The silver chloride or silver chlorobromide containing at least 96 mol% of silver chloride preferably has a crystal structure which has a local phase within the grains. Hereinafter, any local part structure which has a different silver bromide content within the silver halide grains or at the grain surface is referred to as a local phase. In the present invention the presence of a local part structure which has a metal ion other than a silver ion, for example which contains iridium or rhodium, or iron etc, is also referred to as a local phase. Thus, it is possible to have a crystal structure which has local phases even in the case of a pure silver chloride grain when such a grain is considered from the viewpoint of the halogen composition.

When, in the present invention, the silver halide grains are composed of silver chlorobromide, which has an average silver chloride content of at least 96 mol% and a local phase provided on the surface of silver halide grains in which the silver bromide content exceeds 15 mol% is preferred. A local phase which has a silver bromide content in excess of 15 mol% is preferred. A silver bromide content exceeding 70 mol% is undesirable. If the silver bromide content is too high then the extent of so-called pressure desensitization is considerable when an exposure is made after the application of a mechanical pressure to the photosensitive material in which the emulsion has been used, large changes may appear in the photographic performance due to changes in the composition of the processing baths. Of course, this is undesirable from the viewpoint of the performance of the photographic material.

Therefore, the silver iodide content of the local phase is preferably within the range from 15 to 70 mol%, desirably within the range from 20 to 60 mol%, and most desirably in the range from 30 to 50 mol%.

The local phase preferably includes from 0.01 to 20 mol% of all the silver from which the silver halide grains are constructed, and most desirably includes from 0.02 to 7 mol% of the total amount of silver in the silver halide grains.

The boundary between a local phase that has a high silver bromide content and other phases may be a distinct boundary or it may be a boundary region in which the halogen composition changes gradually and continuously.

The silver bromide content of a silver bromide local phase can be analyzed, for example, using an X-ray diffraction method (for example, as described in the Japanese Chemical Society Publication entitled "*New Experimental Chemistry Course 6, Structure Analysis*, published by Maruzen), or the XPS method (for example, as described in "*Surface Analysis, The Application of IMA, Auger Electron—Photoelectron Spectroscopy*, published by Kodansha), and the existence of such a local phase can be shown using electron microscopy.

In the present invention, the silver chlorobromide emulsion or silver chloride emulsion in at least one photosensitive layer is comprised of a silver iodochlorobromide or silver iodochloride which contains from 0.01 to 3 mol% of silver iodide on the grain surface. In this emulsion, the silver iodide must be included at the grain surface as silver iodide, silver iodochloride or silver iodochlorobromide. The silver iodide of this silver halide emulsion preferably forms a silver iodide local phase similar to that of the local silver bromide phase in the silver chlorobromide as described above in the case of a silver iodochloride emulsion In the case of a silver iodochlorobromide emulsion, the silver iodide local phase may be formed independently of the silver bromide local phase, a local phase consisting of silver iodobromide may be formed by forming mixed crystals with silver bromide, or a local, phase can be formed from silver iodide alone and the silver bromide maya be present without forming a local phase. The silver iodide is preferably present on the silver chloride as a phase of pure silver iodide or as a high silver iodide phase approaching a pure silver iodide, or as a silver iodide phase which has a silver iodide content of not more than 10 mol%. In those cases where silver bromide is present in the local phase, the silver iodide may form a mixed crystal with silver bromide or silver chlorobromide and the silver iodide content of the local phase can be up to about 40 mol%. Provided that silver iodide is present in the form of a local phase on the grain surface at least, the conditions for a silver iodochloride or silver iodochlorobromide emulsion of this present invention are satisfied.

The silver iodochloride or silver iodochlorobromide emulsions used in this present invention contain from 0.01 to 3 mol% of silver iodide as a whole on the grain surface. If the silver iodide is less than 0.01 mol% then stable performance with high photographic speed which is the effect of the invention is not achieved. Similarly, the inclusion of more than 3 mol% of silver iodide has an adverse effect on the rapid processing characteristics.

Various methods can be used to form such a silver bromide local phase or silver iodide local phase. For example, a local phase can be formed by reacting a soluble bromide or iodide with a soluble silver salt using a single-jet procedure or a double-jet procedure. Moreover, the local phase can be formed using a so-called halogen conversion method which includes a process in which a silver halide which has been formed is converted to a silver halide which has a lower solubility product. Alternatively, the local phase can be formed by recrystallization by mixing silver halide grains which have a different halogen composition from that of the silver halide which has been formed already and ripening the mixture. In those cases where a silver chlorobromide local phase is to be formed on the surface of silver chloride or silver chlorobromide grains, the local phase is preferably formed by recrystallization which is brought about by adding fine grains of silver bromide which are smaller than the grains of silver chloride or silver chlorobromide which have been formed already and ripening the mixture. In those cases where a silver iodide local phase is to be formed on the surface of silver chloride or silver chlorobromide grains the local phase is preferably formed by a recrystallization which is accomplished by adding fine silver iodide grains which are smaller than the silver chloride or silver chlorobromide grains which have been formed already and ripening the mixture. Moreover, in those cases where a silver iodobromide local phase is to be formed on the surface of silver chloride or silver chlorobromide grains, the local phase is preferably formed by a recrystallization accomplished by adding fine grains of silver iodobromide or fine grains of silver iodide and fine grains of silver bromide which are smaller than the silver chloride grains which have been formed already and ripening the mixture. Fine grains of silver iodide can be added and the mixture can be ripened after adding fine grains of silver bromide and ripening to form a local phase.

Control such as to provide the emulsion with the performance required can be achieved by varying the time of the addition of the halide solution, the addition of the sparingly soluble halide, the addition of the silver salt solution/halogen salt solution or the addition of the fine grain silver halide which is made for forming the local phase, the ripening time and temperature, or the silver ion concentration at the time of the addition/ripening process, or by varying the extent of the halogen conversion or recrystallization.

The silver iodide content of the silver iodochloride emulsion or silver iodochlorobromide emulsion in the present invention is, as mentioned earlier, from 0.01 to 3 mol%, but it is preferably from 0.015 to 2 mol%, more desirably from 0.02 to 1 mol%, and most desirably from 0.03 to 0.6 mol% (based on the mole of silver chloride or silver chlorobromide).

Furthermore, in order to increase sensivitity, inorganic silver salts other than the silver halides, for example silver thiocyanate or silver phosphate, may be included in silver halide grains as a part of light-insensitive silver salt as well as the various silver halides such as those described above in the silver halide emulsions of the present invention. These salts is usually contained in an amount up to 10 mol% based on the mole of silver halide.

The external form of the crystal grains of the silver halide emulsions of the present invention can be regular, such as a cubic, octahedral, tetradecahedral or rhombo-dodecahedral. Or, they can be an irregular form, such as a spherical or tabular form. Furthermore, the grains may have a complex form attained by combining a plurality of these crystal planes, or they may be grains which have higher order crystal planes. Furthermore, they may be mixtures of these silver halide grain types.

Cases in which the emulsions used in the present invention are emulsions such that tabular grains of which the average aspect ratio (the ratio of the diameter of the circle calculated for the principal plane of the grain/grain thickness) is at least 5, and preferably at least 8, account for at least 50% of the total projected area of the grains is convenient from the viewpoint of rapid processing characteristics.

The grain size distribution of the silver halide grains may be wide or narrow, but so-called mono-disperse emulsions are preferred with respect to the stability of the photographic speed. The value S/d, obtained by dividing the standard deviation S of the diameter distribution when the projected area of the silver halide grains is calculated as a circle by the average diameter d, is preferably not more than 20%, and most desirably not more than 15%.

The emulsions preferably used in the present invention are mono-disperse silver halide emulsions such that the content of grains which have a regular crystalline form is at least 50%, preferably at least 70%, and most desirably at least 90%, in terms of the number of grains or by weight. Emulsions which have local phases, as described earlier, on the corners or edges of the cubes of cubic or tetradecahedral silver halide gains which have a (100) crystal plane are especially desirable. In the case of the silver iodide local phase, the presence of this phase on the (100) plane for example rather than the edges or corners is preferred in the present invention. Such a discontinuous isolated local phase on the surface of the silver halide grains can be formed by halogen exchange. This involves supplying bromine ions or iodine ions to an emulsion which contains the basic silver halide grains while controlling the silver ion concentration, the hydrogen ion concentration, the temperature, or the time. In this case the ions are preferably supplied while agitating the system adequately if the halogen ion is required to be spread uniformly with respect to each grain in the system. At the same time, the halogen ion is preferably supplied at a low concentration and gradually. A gradual supply can be achieved, for example, by using an organic halogen compound such as bromosuccinimide or bromopropionic acid, or by using a halogen compound which has been covered with a semi-permeable encapsulating membrane.

Silver ions and halogen ions can also be supplied to an emulsion which contains the basic silver halide grains while controlling the silver ion concentration and silver halide can be grown on limited parts of the silver halide grains. The local phase can be formed by growing silver halide on limited parts such as the edges and corners of the basic silver halide grains by mixing with finer silver halide grains than the basic silver halide grains and carrying out recrystallization. In this case, a silver halide solvent can also be used, as required.

Furthermore, halogen conversion or recrystallization controlling compounds as disclosed in the specifications of European Patent Nos. 0,273,430 and 0,273,429 can also be used, and control can be achieved using fine crystals of silver iodide, silver iodobromide, silver iodochlorobromide or silver iodochloride, for example, in the same way as fine silver bromide crystals.

The grain size of the silver halide crystals which are contained in the silver halide emulsions used in the present invention is such that the average diameter of the spheres of corresponding volume is preferably at least 0.05 μm and not more than 2 μm, and most desirably at least 0.1 μ and not more than 1.5 μ.

The silver halide emulsions of the present invention can be prepared using the methods disclosed, for example, by P. Glafkides in *Chimie et Physique Photographique* (Paul Montel, 1967), by G. F. Duffin in *Photographic Emulsion Chemistry*, (Focal Press, 1966), and by V. L. Zelikmann et al. in *Making and Coating Photographic Emulsions*, (Focal Press, 1964).

These are acidic methods, neutral methods and ammonia methods for example, but the acid methods and neutral methods are preferred from the point of view of minimizing fog in the present invention. Preparation with a hydrogen ion concentration lower than neutrality is preferred in order to attain high photographic speed. A so-called single jet procedure, a double jet procedure or any combination of such procedures can be used for reacting the soluble silver salt with the soluble halogen salt to obtain a silver halide emulsion. So-called reverse mixing methods in which the grains are formed under conditions of excess silver ion can also be used. The use of double jet methods is preferred for obtaining the preferred mono-disperse emulsions of the present invention. Use of the method in which the silver ion concentration in the liquid phase (where the silver halide being formed) is held constant, so-called controlled double jet method, is especially desirable. It is possible to obtain mono-disperse emulsions with a regular silver halide crystal form and a narrow grain size distribution which are preferred in the present invention by using this method.

Cadmium salts, zinc salts, lead salts, thallium salts, or the iridium salts or complex salts, rhodium salts or complex salts, or iron salts or complex salts may also be present during the formation or physical ripening processes of such silver halide grains.

It is possible to obtain the preferred silver halide emulsions which have a regular silver halide crystal form and a narrow grain size distribution in the present invention if a silver halide solvent (for example, the known silver halide solvents such as ammonia, thiocyanate or the thioether compounds and thione compounds disclosed, for example, in U.S. Pat. No. 3,271,157, JP-A-51-12360, JP-A-53-82408, JP-A-53-144319, JP-A-54-100717 and JP-A-54-155828) are used during or after the formation of the grains and together with the methods described above.

Noodle washing, flocculation precipitation methods and ultra-filtration, for example, can be used to remove the soluble salts from the emulsion after physical ripening.

The emulsions used in this present invention can be chemically sensitized by sulfur sensitization, selenium sensitization, reduction sensitization, or precious metal sensitization and either individually or together. That is to say, sulfur sensitization methods in which active gelatin or compounds which contain sulfur which can react with silver ions (for example, thiosulfates, thiourea compounds, mercapto compounds and rhodanine compounds) are used, reduction sensitization methods in which reducing substances (for example, stannous salts, amines, hydrazine derivatives, formamidinesulfinic acid, silane compounds and ascorbic acid) are used, and precious metal sensitization methods in which metal compounds (for example, the aforementioned gold complex salts and salts and complex salts of the metals of group VIII of the periodic table, such as platinum, iridium, palladium, rhodium and iron) are used can be used either independently or in combination. The use of sulfur sensitization or selenium sensitization is preferred, and the conjoint use of gold sensitization is especially desirable for the emulsion of the present invention. Furthermore the presence of hydroxyazaindene compounds or nucleic acids during the sensitization is desirable for controlling photographic speed and gradation.

The inclusion of metal ions (for example, ions of metals of group VIII of the periodic table, group II transition metal ions, and lead ions from group IV and gold ions and copper ions from group I), or complex ions, rather than silver ions in the silver halide grains used in the present invention is desirable for fully realizing under various conditions the photographic speed stabilizing effect of the present invention. These metal ions or complex ions may be included in the silver halide grains as a whole, in the aforementioned local phases or in other phases.

Of the aforementioned metal ions or complex ions, the selection of iridium ion, palladium ion, rhodium ion, zinc ion, iron ion, platinum ion, gold ion or copper ion for example is especially useful. Many desirable photographic properties can be obtained by the joint rather than individual use of these metal ions or complex ions. A change in the type of ion added and the amount added between the local phase and other parts of the grains is desirable. The inclusion of iridium ion and rhodium ion in a local phase is especially desirable.

For inclusion in the local phase or other parts of the silver halide grains, the metal ion or complex ion can be added directly to the reactor before or during the formation of the silver halide grains or during the physical ripening after grain formation, or they may be added beforehand to the liquid used for the addition of the water soluble halogen salt to the water soluble silver salt. In those cases where a local phase is formed using fine grains of silver bromide or silver iodide, the metal ions or complex ions can be included in the fine grains of silver bromide or silver iodide using the same methods as described above for addition to the silver chloride or high silver chloride emulsion. Furthermore, a local phase can be formed and the metal ions can be included by adding comparatively insoluble bromides or iodides of the metal ions mentioned above for example instead of a silver salt in the form of a solid or a powder.

The emulsions prepared in the ways described above in the present invention give improved photographic speed, improved stability of the photographic speed, and improved latent image stability overall. These factors, have caused problems with high silver chloride emulsions which have been sensitized to the red or infrared region, and also enable the characteristics of the high silver chloride emulsions with respect to rapid processing to be realized satisfactorily.

The inclusion of a silver iodochloride emulsion or a silver iodochlorobromide emulsion which contains silver iodide on the grain surface in at least one photosensitive layer is essential in the present invention, as is the inclusion of three photosensitive layers which have spectral sensitivity peaks in three different light wavelength regions of not smaller than 650 nm. It is desirable that the emulsion of the photosensitive layer which has the spectral sensitivity peak of the longest wavelength should contain the silver iodochlorobromide emulsion or silver iodochloride emulsion which contains from 0.01 to 3 mol% of silver iodide in the grain surface. Moreover, the emulsion in the photosensitive layer which has the spectrally sensitized peak of the longest wavelength and the emulsion in the photosensitive layer which has the spectrally sensitized peak in the next longest wavelength region are preferably silver iodochlorobromide emulsions or silver iodochloride emulsions which each have from 0.01 to 3 mol% of silver iodide on the grain surfaces. The features of stability with high photographic speed of the photographic materials of the present invention can be realized adequately in particular when this is applied to a photographic material wherein spectral sensitization is carried out in such a way that the peak of the photographic layer which has been spectrally sensitized to the longest wavelength region and the peak of the photosensitive layer which has been spectrally sensitized to the next longest wavelength are both spectrally sensitized to a wavelength longer than 720 nm.

There are also cases in which it is desirable that all three photosensitive layers should be silver iodochlorobromide emulsions or silver iodochloride emulsions which each contain from 0.01 to 3 mol% of silver iodide in the grain surfaces in order to obtain, for example, a high speed.

The three photosensitive layers of a silver halide color photographic material in the present invention are preferably photosensitive layers which have spectral sensitivity peaks of 650–690 nm, 720–790 nm and 770–850 nm respectively, but the invention is not limited to these ranges. The wavelength differences between two of these peaks adjacent to each other are preferably 20 nm or more.

The order of layers each containing a cyan, magenta and yellow couplers, respectively, is optional. Furthermore, the combinations of these couplers with color sensitivity of the layers are also optional.

High and stable photographic speeds can be obtained when the silver halide color photographic materials of the present invention are subjected to a scanning exposure with light of these wavelengths. The scanning exposure is preferably carried out in such a way that the average exposure time for one picture element is not more than $10^{-3}$ second, and more desirably not more than $10^{-5}$ second. An exposure time of not more than $10^{-7}$ seconds is most preferred from the viewpoint of obtaining the image rapidly. By adjacently overlapping a short, very bright scanning exposure of this type, an intermittent exposure or a multiple exposure becomes admitted, and each is desirable, for the exposure characteristics of the photographic material and the method of scanning exposure image formation.

Subsequent development processing preferably includes a color development time of not more than 60 seconds, a total processing time, excluding drying, of not more than 180 seconds and a drying time of not more than 60 seconds: the processing is preferably started within 40 seconds after the scanning exposure for achieving rapid processing in a stable manner. Processing having a color development time of not more than 20 seconds, a total processing time, excluding drying, of not more than 90 seconds and a drying time of not more than 30 seconds which is started within 20 seconds after making the scanning exposure is preferred. Processing such that the color development time is not more than 10 seconds, the total processing time, excluding drying, is not more than 45 seconds and the drying time is not more than 15 seconds which is started within 5 seconds after the scanning exposure is most desirable. The processing operation preferably comprises a color development process, a bleach-fix process, a water washing or stabilizing process and a drying process, but the bleach-fix proces may be divided into a bleaching process and a fixing process and these may be used in combination. The color development process and the bleach/fixing process may be systems in which so-called running replenishment is carried out. In-the present invention a use and discard system, or a batch discard system, of processing is preferred, and such a system is especially desirable for maintaining the stability of the processing performance in cases where the silver iodide content of the silver halides in the photographic material is high.

The part by which the material is passed from exposure to development processing transports the photographic material in a direction more or less at right angles to the exposing light scanning direction and the residence time and waiting time of the photosensitive material which is being transported can be minimized by establishing this part in such a way that the transporting speed is from 0.8 to 1.25 times the transporting speed in the development processing operation and this is desirable for improving the overall rapidity of processing. More desirably, the transporting speed ratio is set at 0.8 to 1.1, and most desirably the transporting speed ratio is set to a value of about 1. In this case, not only is the residence time and waiting time of the photographic material which is being transported eliminated and the rapid processing characteristics improved, but the time from exposure of the photographic material until development processing is then constant for the whole surface of the photographic material. This makes it possible to form images in a stable manner without any effects from characteristics or behavior of the photographic material resulting from changes in the latent image after exposure is stable.

Actual examples of the semiconductor lasers which can be used in the present invention include those in which materials such as $In_{1-x}Ga_xP$ (about 700 nm), $GaAs_{1-x}P_x$ (610–900 nm), $Ga_{1-x}Al_xAs$ (690–900 nm), for example, are used. The light which is directed onto the color photographic material in the present invention may be light emitted by the above mentioned semiconductor lasers or it may be light from a YAG laser in which an Nb:YAG crystal is excited by means of a $GaAs_xP_{1-x}$ light emitting diode. The use of light selected from among the semiconductor laser light beams of wavelength 670, 680, 750, 780, 810 and 830 is preferred.

The yellow coupler containing photosensitive layer, the magenta coupler containing photosensitive layer and the cyan coupler containing photosensitive layer in a color photosensitive material of the present invention are preferably each spectrally sensitized to match with laser light beams of three wavelengths as indicated below.

EXAMPLE 1

Oscillating Wavelength

660–680 nm (AlGaInP)
730–770 nm (GaAlAs)
790–830 nm (GaAlAs)

EXAMPLE 2

Oscillating Wavelength

660–680 nm (AlGaInP)
760–790 nm (GaAlAs)
810–850 NM (GaAlAs)

EXAMPLE 3

Oscillating Wavelength

660–680 nm (AlGaInP)
730–770 nm (GaAlAs)
810–850 nm (GaAlAs)

The output device disclosed in Japanese Patent Application No. 63-226552 (corresponding to U.S. Ser. No. 07/367079) can be used in this present invention.

DETAILED DESCRIPTION OF THE DRAWING

FIG. 1 is an outline cross sectional view of copying equipment which can be used in the present invention.

The body 11 of the copying equipment contains a photographic material supply unit 12 on the right hand side, an exposing unit 14 in the top and a processing unit 16 in the bottom. The exposing unit 14 has an image reading unit 200, image processing equipment 250 and exposing equipment 300. The processing unit 16 has a processing part 17 in the upper right hand side, a drying part 18 in the upper left hand side and a prepared liquid storage part 19 for storing supply bottles for processing bath replenishment purposes in the bottom part.

Labels 60 and 100 show outer covers of the apparatus.

A pair of magazines 20, 22 can be established one above the other in the photographic material supply unit 12. Photographic materials 24 and 26 are housed in magazines 20 and 22, respectively, in the form of rolls. The photographic material 24 or 26 is supplied from the end thereof, to the photographic supply unit 12. For example, 24 could be photographic material for copying color photograph originals and 26 could be photographic material for copying color printing originals.

The photographic material 24 or 26 which is pulled out from the magazine 20 or 22 is fed into an exposing part 28 via the photographic material supply unit 12 and exposed with an image of a color original 32 which is on a transparent original table 30 established at the top of the exposing unit 14. The color original 32 is pressed into contact with the original table 30 by a press 34 and illuminated by a light source 208 inside the image reading equipment 200 and the image of the color original 32 which has been reflected by a plurality of mirrors 210, 212, 214 and passed through an image focusing lens 218 and read with a CCD sensor 220. The read out picture is processed for color correction and gradation changes, for example, in the image processing equipment 250 so that the photographic material 24 (26) in the exposing part 28 can be exposed by means of the exposing equipment 300.

At the time of a pre-scan or correction of the white balance for example, the image due to the original picture or the white sheet 2 is input to the CCD sensor via the mirrors 210, 212 and 214 and the lens 218 so that the exposure correction conditions can be determined.

In the processing unit 16, a developing tank 46, a bleach-fix tank 48 and water washing tanks 50, 52 are continously established within the processing part 17. The photographic material 24 (26) is developed, bleached, fixed and washed in the processing solutions which have been introduced into these parts and sent to the drying part 18.

After drying, the photographic material 24 (26) is sent to a take-out tray 54.

The image processing equipment which is combined with the exposing equipment in the described copying machine which can be used in the present invention. This equipment may be linked with an image reading equipment, and an output part sensor 400, and the hue, saturation and brightness signals of the image receiving paper are input into the image reading equipment, and color correction processing can be carried out. A color gradation conversion (for example, a look up table system) can be included on the basis of the color gradation characteristics of the color photographic material which have been input previously and the exposure is then made. Furthermore, the exposing part and the processing part are connected essentially.

In FIG. 1, part 2 is a white sheet, part 102 is a pin, part 270 is a polygonal mirror, part 280 is a focus lens, and part 290 is a mirror.

The processing part of image processing equipment which can be used in the present invention can be a normal mini-lab processing mechanism. It also may be constructed from processing tanks where the processing liquids are introduced into an enclosed space in which they are essentially free from exposure to air; from slit like processing tanks; or from a processing tank which has a number of chambers with narrow parts in the processing path for the development, de-silvering, water washing and/or stabilizing processes.

In image processing equipment using the present invention, a gradation conversion process can be used. This reduces the amount of silver halide used in the color photographic material by improving the color photographic material making it possible to omit or simplify the de-silvering process.

A slit like processing tank that can be used with the present invention is such that the path within the processing tank through which the photographic material is passed is sectioned at right angles to the direction in which the photographic material is running. The cross section of this tank has a so-called slit form where the thickness is less than the cross width (in the direction of the width of the photographic material). The cross section of the slit may be rectangular or it may be elliptical.

A processing tank having a slit like processing path that can be used with the present invention can be defined in the following way:

$V/L \leqq 20$ where V is the volume ($cm^3$) of the processing solution contained in the processing tank; and L is the length (cm) of the center line of the path of the photographic material from the liquid surface on the inlet side of the photographic material to the liquid surface on the outlet side of the photographic material in the processing tank (the processing path length). More desirably, $V/L \leqq 10$. It is desirable that a value of 0.1, and preferably a value of 0.5, should be chosen as a lower limit in practice for V/L.

A slit like processing tank generally houses a small quantity of liquid with respect to the length of the pathway. Since the amount of liquid being used is small, replacement of the liquid in the processing tank by replenishment of the processing bath is rapid. In other words, the residence time of the liquid in the processing tank is short, thus avoiding ageing and fatigue in the processing bath.

In practice, a value of from 10,000 to 100 $cm^3$ is preferred, a value of from 5,000 to 200 $cm^3$ is more desirable and a value of from 1,000 to 300 $cm^3$ is most desirable for V. A value of from 300 to 10 cm is preferred, a value of from 200 to 20 cm is more desirable and a value of from 100 to 30 cm is most desirable for the value of L.

When carrying out processing using slit like processing tanks, the use of processing tanks where the liquid surface area S in contact with the air (referred to hereinafter as the open area) is small with respect to the liquid volume V is preferred. In practice, the following relationship is desirable for V and S.

$S/V \leqq 0.05$

Most desirably, $S/V \leqq 0.01$. Thus, the likelihood of aerial oxidation is reduced as S/V becomes smaller; and liquid evaporation is also reduced. This makes it possible to retain the liquid in a stable state for a longer period of time. In practice a lower limit of 0.0005 is preferred, and a lower limit of 0.001 is most desirable.

The use of spectrally sensitizing dyes is important in the present invention. Cyanine dyes, merocyanine dyes, and complex merocyanine dyes, for example, can be used. Complex cyanine dyes, holopolar cyanine dyes, hemi-cyanine dyes, styryl dyes and hemi-oxonol dyes can also be used. Simple cyanine dyes, carbocyanine dyes and dicarbocyanine dyes can be used as cyanine dyes. Sensitizing dyes can be selected from among those represented by the general formulae (I), (II) and (III) indicated below and used for providing red—infrared sensitivity. These sensitizing dyes are distinguished by being comparatively stable in chemical terms; quite strongly adsorbed on the surface of silver halide grains; and highly resistant to desorption by the dispersions of couplers, for example, which are also present.

At least one, and preferably at least two, of the at least three photosensitive silver halide layers of the present invention are spectrally sensitized selectively to match one of the wavelength regions of semiconductor laser light beams, namely 650–690 nm, 720–790 nm, and 770–850 nm, using at least one type of sensitizing dye selected from among the group of compounds represented by the general formulae (I), (II) and (III).

In the present invention, the expression "spectrally sensitized selectively to match one of the wavelength regions of semiconductor laser light beams, namely 650–690 nm, 720–790 nm, and 770–850 nm" signifies spectral sensitization such that when the principal wavelength of one laser light beam is within any one of the above mentioned wavelength regions, in comparison to the photo-graphic speed at the principal wavelength of the laser light beam of the principal photosensitive layer which has been spectrally sensitized to match the principal wavelength of this laser light beam, the photographic speed of the other photosensitive layers at this principal wavelength is in practice at least 0.5 (log representation) lower. For this reason it is desirable that the principal sensitized wavelength of each photosensitive layer, corresponding to the principal semiconductor laser light beam in use, should be separated by at least 20 nm, and 30 nm is more desirable. The sensitizing dyes which are used are dyes which provide high photographic speed at the principal wavelength and which provide a sharp spectral sensitivity distribution. Furthermore, the phrase "principal wavelength" as used herein relates to laser light which has essentially coherent light but, in practice, there is an incoherency and so a certain width must be taken into consideration.

The sensitizing dyes which can be represented by the general formulae (I), (II) and (III) are described below.

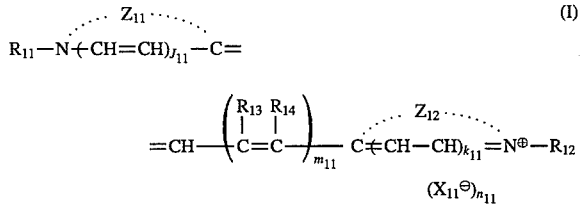

(I)

In this formula, $Z_{11}$ and $Z_{12}$ each represent a group of atoms which is required to form a heterocyclic ring.

The heterocyclic ring is preferably 5- or 6-membered rings which may further contain, at least one of a nitrogen atom, a sulfur atom, an oxygen atom, a selenium atom or a tellurium atom as hereto-atom (and the ring may be bound with a condensed ring and it may be substituted with at least one substituent).

Actual examples of the aforementioned heterocyclic nuclei include a thiazole nucleus, a benzothiazole nucleus, a naphthothiazole nucleus, a selenazole nucleus, a benzoselenazole nucleus, a naphtho-selenazole nucleus, an oxazole nucleus, a benzoxazole nucleus, a naphthoxazole nucleus, a imidazole nucleus, a benzimidazole nucleus, a naphthimidazole nucleus, a 2-or 4-quinoline nucleus, a pyrroline nucleus, a pyridine nucleus, a tetrazole nucleus, an indolenine nucleus, a benzindolenine nucleus, an indole nucleus, a tellurazole nucleus, a benzotellurazole nucleus and a naphtho-tellurazole nucleus.

$R_{11}$ and $R_{12}$ each represent an alkyl group, an alkenyl group, an alkynyl group or an aralkyl group. These groups and the groups described hereinafter (in the definition for formulae (II), (II)' and (III)) include groups which have substituent groups. For example, "alkyl groups" include both unsubstituted and substituted alkyl groups, and these groups may be linear chain, branched or cyclic groups. The alkyl group and the alkenyl group each (unsubstituted or before substitution; the same hereinafter) preferably has from 1 to 8 carbon atoms.

Furthermore, actual examples of substituent groups for substituted alkyl, alkenyl, alkynyl and aralkyl groups include halogen atoms (for example, chlorine, bromine, fluorine), cyano groups, alkoxy groups, substituted and unsubstituted amino groups, carboxylic acid groups, sulfonic acid groups and hydroxyl groups. The alkyl groups may be substituted with one, or with a plurality, of these groups.

The vinylmethyl group is an example of an alkenyl group. Benzyl and phenethyl are examples of aralkyl groups.

Moreover, $m_{11}$ represents an integer of 2 or 3.

$R_{13}$ represents a hydrogen atom, and $R_{14}$ represents a hydrogen atom, a lower alkyl group (having from 1 to 4 carbon atoms; the same hereinafter) or an aralkyl group, or it may be joined with $R_{12}$ to form a 5-or 6-membered ring. Furthermore, in those cases where $R_{14}$ represents a hydrogen atom, $R_{13}$ may be joined with another $R_{13}$ group to form a hydrocarbonyl or heterocyclic ring. These rings are preferably 5- or 6-membered rings containing at least one of N, O and S atoms (the same hereinafter). Moreover, $j_{11}$ and $k_{11}$ represent 0 or 1, $X^{\ominus}_{11}$ represents an acid anion, such as $Ci^-$, $Br^-$, $I^-$, $SCN^-$ and p-toluenesulfonic acid anion, and $n_{11}$ represents 0 or 1.

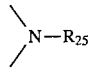

group, and $R_{25}$ has the same significance as $R_{23}$. Moreover, $j_{21}$, $k_{21}$, $X_{21}^{\ominus}$ and $n_{21}$ have the same significance as $j_{11}$, $k_{11}$, $X_{11}^{\ominus}$ and $n_{11}$, respectively.

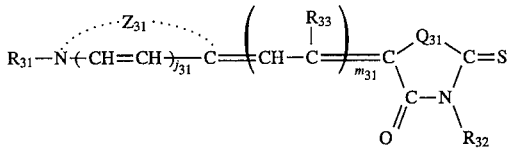

(III)

In this formula, $Z_{31}$ represents a group of atoms which is required to form a heterocyclic ring. Actual examples of this ring include, in addition to those described in connection with $Z_{11}$ and $Z_{12}$, a thiazolidine, a thiazoline, a benzothiazoline, a naphthothiazoline, a selenazolidine, a selenazoline, a benzoselenazoline, a naphthoselenazoline, a benzoxazoline, a naphthoxazoline, a dihydropyridine, a dihydroquinoline, a benzimidazoline and a naphthoimidazoline nuclei.

$Q_{31}$ has the same significance as $Q_{21}$. $R_{31}$ has the same significance as $R_{11}$ or $R_{12}$, and $R_{32}$ has the same significance as $R_{23}$. Moreover, $m_{31}$ represents 2 or 3. $R_{33}$ has the same significance as $R_{24}$, or it may be joined with another $R_{33}$ group to form a hydrocarbyl or heterocyclic ring. Moreover, $j_{31}$ has the same significance as $j_{11}$.

Sensitizing dyes in which the heterocyclic nucleus formed by $Z_{11}$ and/or $Z_{12}$ in general formula (I) is a naphthothiazole nucleus, a naphthoselenazole nucleus, a naphthoxazole nucleus, a naphthoimidazole nucleus, or a 4-quinoline nucleus are preferred. The same is true of $Z_{21}$ and/or $Z_{22}$ in general formula (II) and also $Z_{31}$ in general formula (III). Furthermore, the sensitizing dyes in which the methine

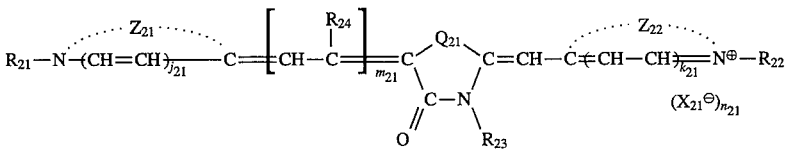

(II)

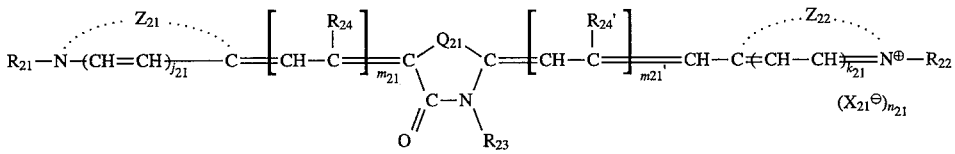

(II)'

In this formula, $Z_{21}$ and $Z_{22}$ have the same significance as $Z_{11}$ and $Z_{12}$, respectively. $R_{21}$ and $R_{22}$ have the same significance as $R_{11}$ and $R_{12}$, respectively, and $R_{23}$ represents an alkyl group, an alkenyl group, an alkynyl group or an aryl group (for example, substituted or unsubstituted phenyl group). Moreover, $m_{21}$ represents an integer of 2 or 3. $R_{24}$ represents a hydrogen atom, a lower alkyl group or an aryl group, or $R_{24}$ may be joined with another $R_{24}$ group to form a hydrocarbyl or heterocyclic ring. These rings are preferably 5- or 6-membered rings. $R'_{24}$ and $m'_{21}$ have the same significance as $R_{24}$ and $m_{21}$, respectively. The alkyl and alkenyl groups each preferably has from 1 to 8 carbon atoms.

$Q_{21}$ represents a sulfur atom, an oxygen atom, a selenium atom or an chain forms a hydrocarbonyl ring or a heterocyclic ring are preferred.

Sensitization with the M-band of the sensitizing dye is used for infrared sensitization, and so in general, the spectral sensitivity distribution is broader than sensitization with the J-band. Consequently, the provision of a colored layer by incorporating a dye is in a colloid layer on the photosensitive surface side of the prescribed photosensitive layer and correction of the spectral sensitivity distribution is desirable. Such a colored layer effectively prevents color mixing by a filter effect.

Compounds which have a reduction potential of −1.00 (V vs. SCE) or below are preferred for the sensitizing dyes for red-infrared sensitization purposes, and of these compounds, those which have a reduction potential of −1.10 or below are preferred. Sensitizing dyes which have these characteristics are effective for providing high sensitivity and especially for stabilizing the photographic speed and the latent image.

The measurement of reduction potentials can be carried out using phase discrimination type second harmonic alternating current polarography. This can be carried out by using a dropping mercury electrode for the active electrode, a saturated calomel electrode for the reference electrode and platinum for the counter electrode.

Furthermore, the measurement of reduction potentials with phase discrimination type second harmonic alternating current voltammetry using platinum for the active electrode has been described in *Journal of Imaging Science*, Vol. 30, pages 27–45 (1986).

Preferably, they are used in combination with a compound selected from the group consisting of the compounds represented by formulae (IV), (V), (VI) and (VII) or a compound selected from the group consisting of the condensates of formaldehyde with compounds represented by formulae (VIII-a), (VIII-b) and (VIII-c) described in Japanese Patent Application No. 63-310211 (U.S. patent application Ser. No. 07/448,176 filed on Dec. 8, 1989.

Examples of the sensitizing dyes represented by the formulae (I), (II), (III) and (III)' are shown below.

(V-1)

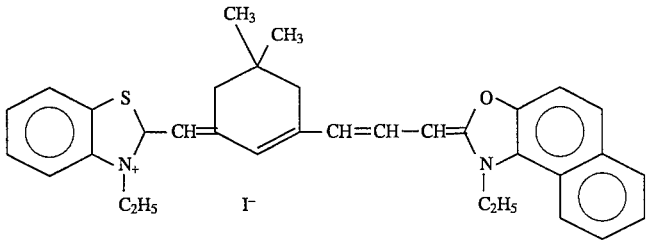

(V-2)

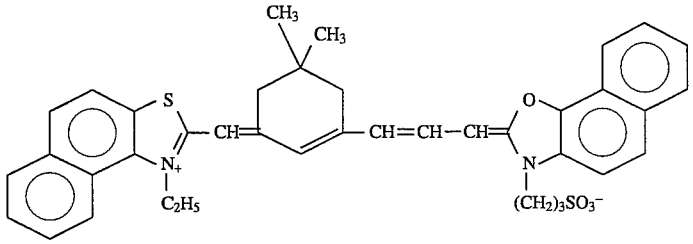

(V-3)

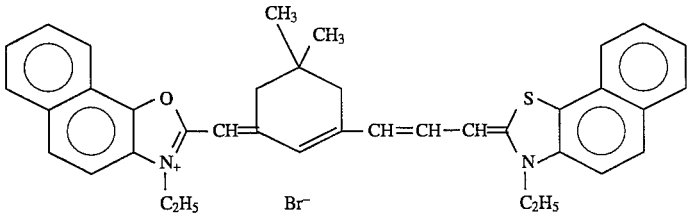

(V-4)

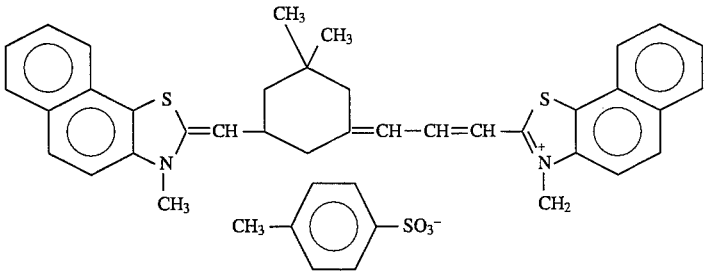

(V-5)

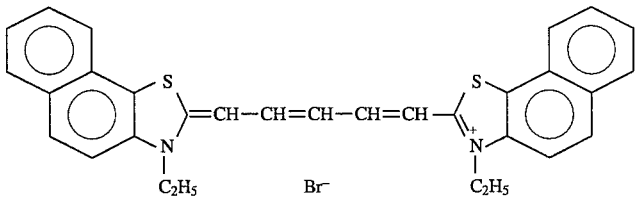

-continued
(V-6)
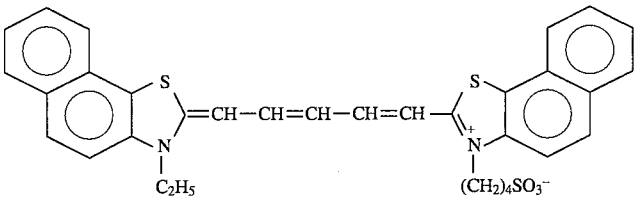
(V-7)
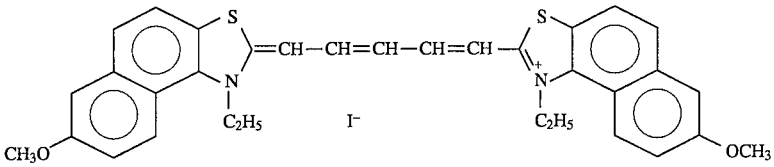
(V-8)
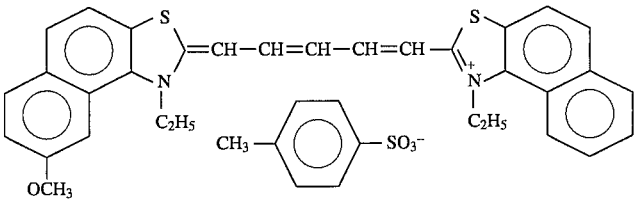
(V-9)
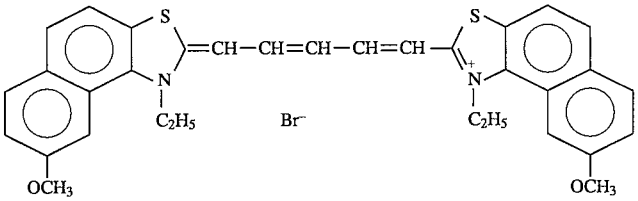
(V-10)
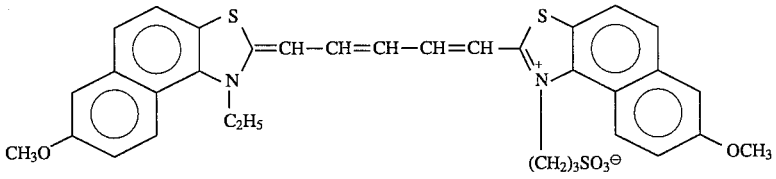
(V-11)
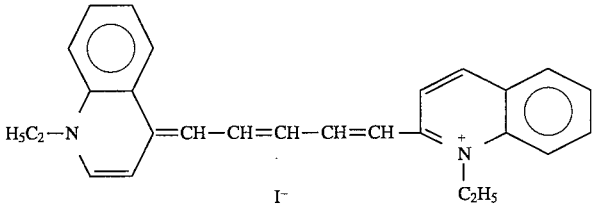
(V-12)
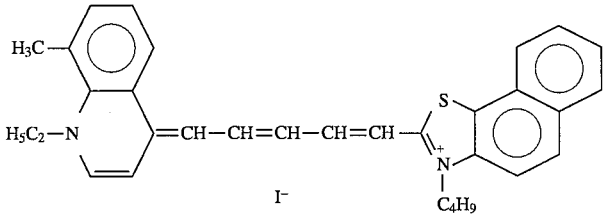
(V-13)
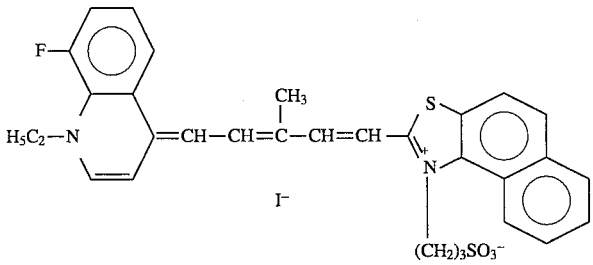

-continued
(V-14)
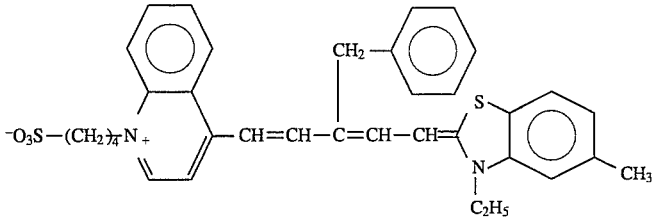
(V-15)
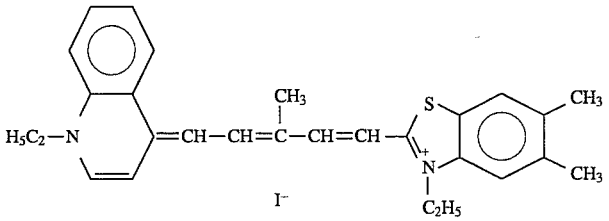
(V-16)
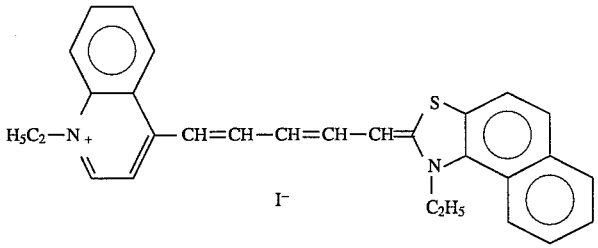
(V-17)
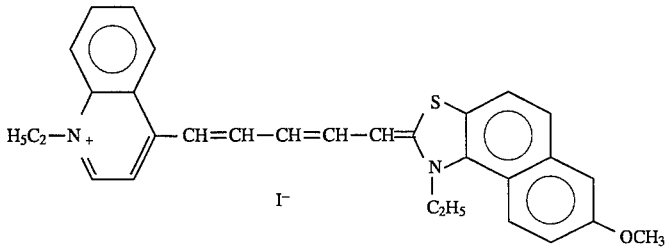
(V-18)
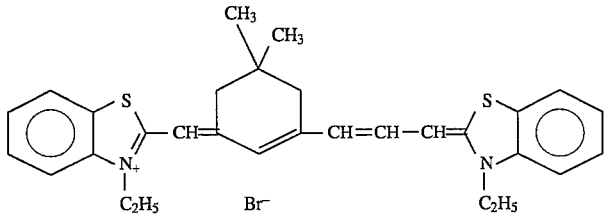
(V-19)
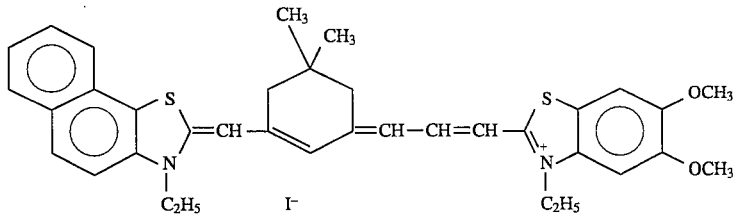
(V-20)
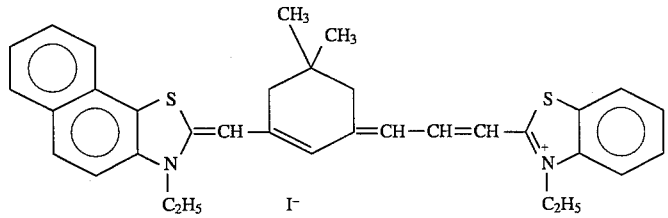

-continued
(V-21)
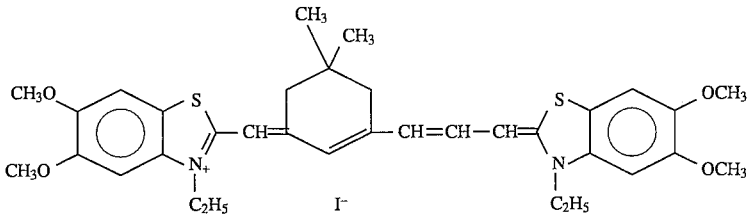
(V-22)
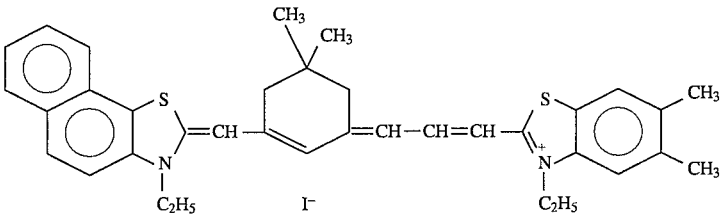
(V-23)
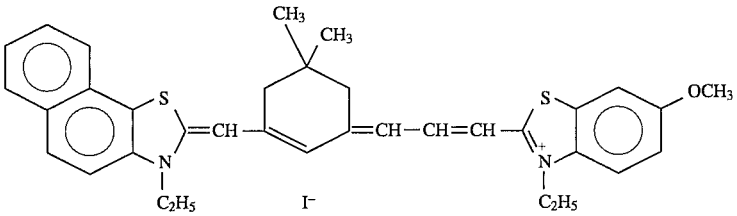
(V-24)
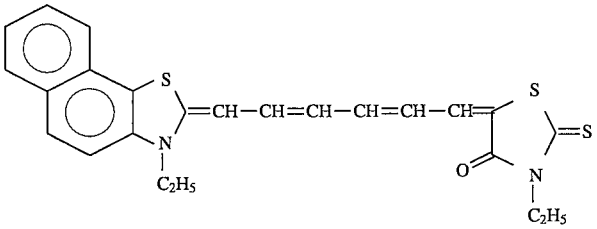
(V-25)
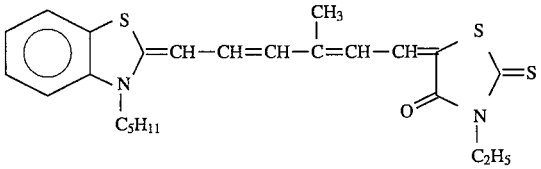
(V-26)
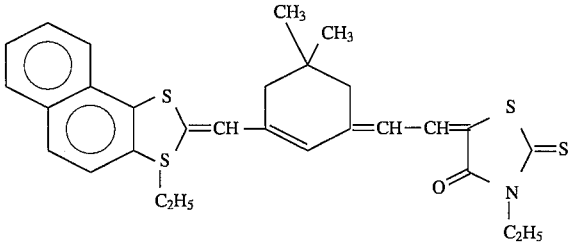
(V-27)
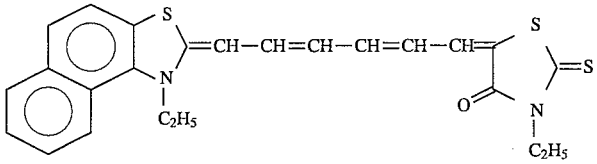
(V-28)
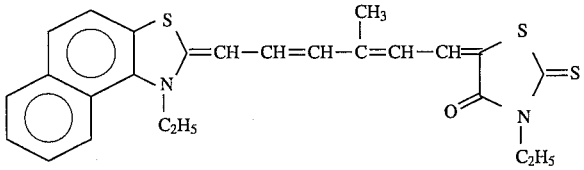

-continued
(V-29)
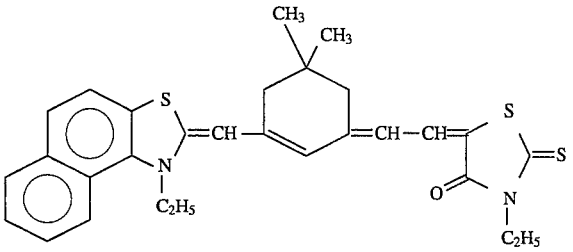
(V-30)
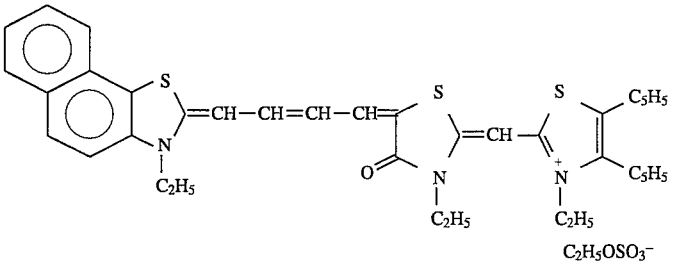
(V-31)
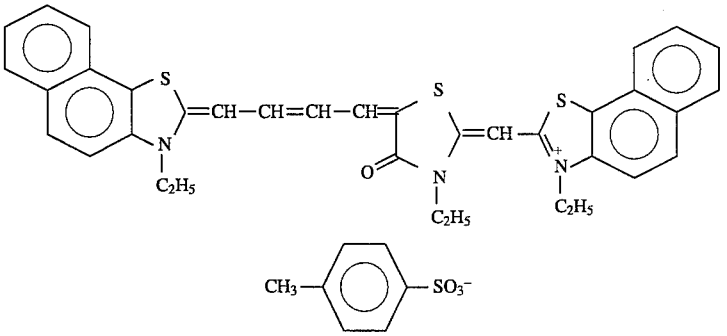
(V-32)
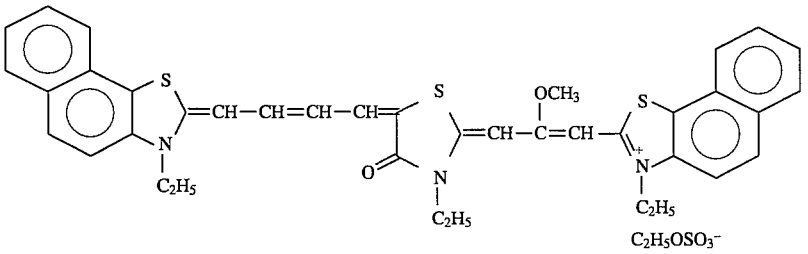
(V-33)
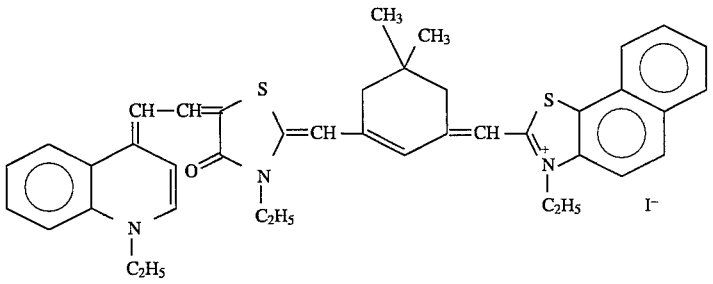
(V-34)
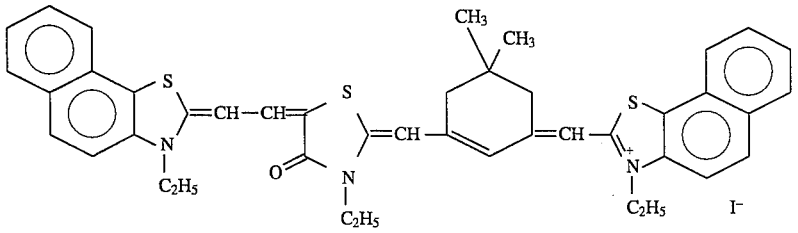

-continued
(V-35)
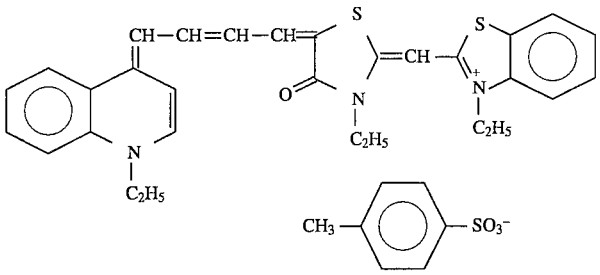
(V-36)
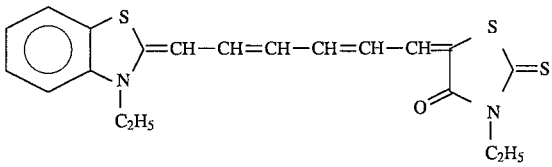
(V-37)
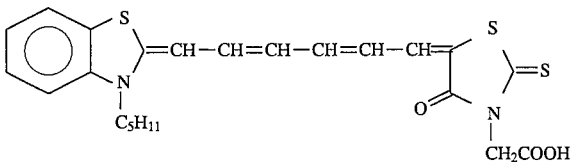
(V-38)
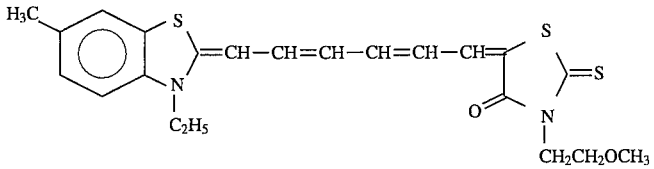
(V-39)
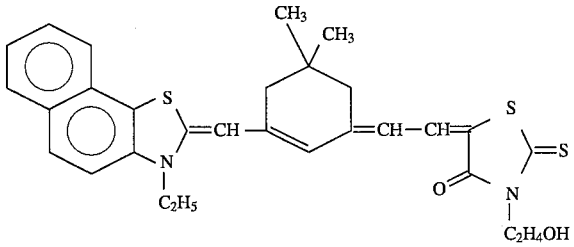
(V-42)
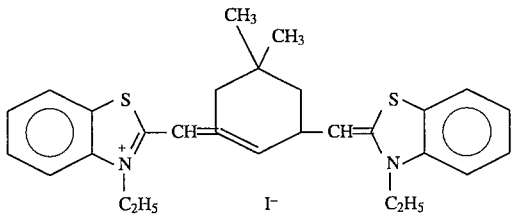
(V-43)
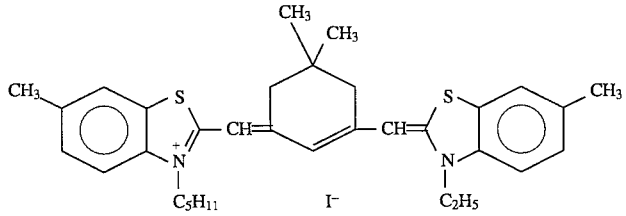

-continued (V-44)

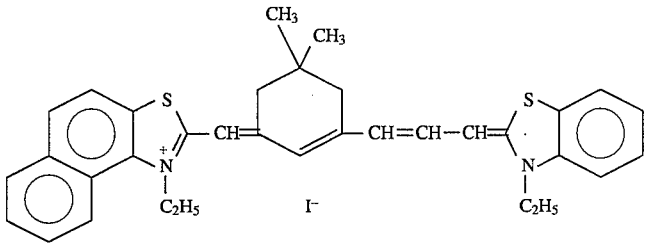

(V-45)

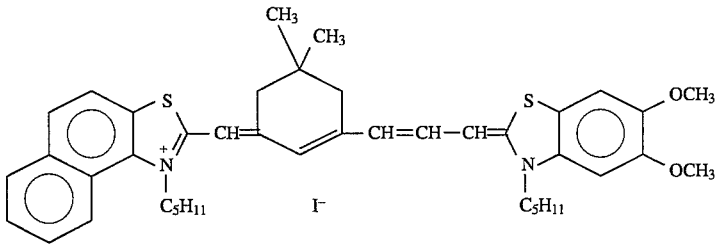

The sensitizing dyes used in the present invention are included in the-silver halide photographic emulsion preferably in an amount of from 5×10 to 5×10 mol, preferably in an amount of from $1\times10^{-6}$ to $1\times10^{-3}$ mol, and most preferably in an amount of from $2\times10^{-6}$ to $5\times10^{-4}$ mol, per mol of silver halide.

The sensitizing dyes used in the present invention can be dispersed directly into the emulsion. Furthermore, they can be dissolved in a suitable solvent, such as methyl alcohol, ethyl alcohol, methyl-cellosolve, acetone, water or pyridine, or in a mixture of such solvents, and added to the emulsion in the form of a solution. Furthermore, ultrasonics can be used for dissolution purposes. In addition, the infrared sensitizing dyes can be added using methods in which the dye is dissolved in a volatile organic solvent. The solution so obtained is dispersed in a hydrophilic colloid and the dispersion so obtained is dispersed in the emulsion, as disclosed, for example, in U.S. Pat. No. 3,469,987. Methods in which a water insoluble dye is dispersed in a water soluble solvent without dissolving and the dispersion is added to the emulsion are disclosed, for example, in JP-B-46-24185. Methods in which the dye is dissolved in a surfactant and the solution so obtained is added to the emulsion are disclosed in U.S. Pat. No. 3,822,135. Methods in which a solution is obtained using a compound which causes a red shift and in which the solution is added to the emulsion are disclosed in JP-A-51-74624. Methods in which the dye is dissolved in an essentially water free acid and the solution is added to the emulsion are disclosed in JP-A-50-80826. (The term "JP-B" as used herein signifies an "examined Japanese patent publication"). Furthermore, the methods disclosed, for example, in U.S. Pat. Nos. 2,912,343, 3,342,605, 2,996,287 and 3,429,835 can also be used for making the addition to an emulsion. Also, the above-mentioned infrared sensitizing dyes can be uniformly dispersed in the silver halide emulsion prior to coating on a suitable support. The addition can be made prior to chemical sensitization or during the latter half of silver halide grain formation.

It is preferred that couplers giving color developed couplers in a high molar ratio to developed silver halide are used in the silver halide color photographic material of the present invention so as to be adapted to rapid color development, whereby the amount of sensitive silver halide to be used can be reduced. Two equivalent type couplers are particularly preferred. Furthermore, one equivalent type couplers may be used in combination therewith. In this method, the quinone diimine derivative of an aromatic amine of a color developing agent is coupled with a color coupler, and a one electron oxidation color formation stage subsequent to said coupling reaction is carried out using an oxidizing agent other than silver halide.

Generally, color couplers which provide a maximum developed color density of at least 3 in terms of transmission density and of at least 2 in terms of reflection density are used in color photographic materials. In the image forming method using the exposure unit in the present invention, if color correction processing in combination with color gradation conversion processing is carried out in the image processing device an excellent color image is obtained at a maximum developed color reflection density of at least about 1.2, and preferably about 1.6 to 2.0. Therefore, the amount of the color couplers and sensitive silver halide used in the color photographic material of the present invention can be reduced.

In the color photographic materials, particularly in the reflection color photographic material of the present invention, a yellow coupler, a magenta coupler and a cyan coupler preferably are used in an amount of 2.5 to $10\times10^{-4}$ mol/m$^2$, 1.5 to $8\times10^{-4}$ mol/m$^2$ and 1.5 to $7\times10^{-4}$ mol/m$^2$, respectively.

Couplers for use in the color photographic material of the present invention are illustrated below.

Cyan couplers, magenta couplers and yellow couplers which are preferably used in the present invention are represented by the following general formulae (C-I), (C-II), (M-I), (M-II) and (Y).

(C-1)

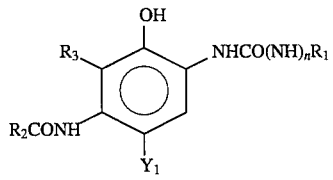

(C-II)

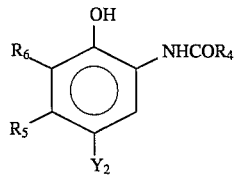

-continued

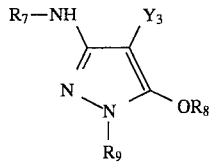

(M-I)

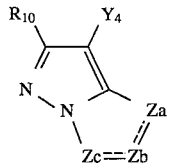

(M-II)

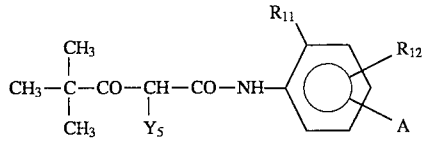

(Y)

In general formulae (C-I) and (C-II), $R_1$, $R_2$, and $R_4$ each represents a substituted or unsubstituted aliphatic group, aromatic group or heterocyclic group, $R_3$, $R_5$ and $R_6$ each represents a hydrogen atom, a halogen atom, aliphatic group, aromatic group or acylamino group and $R_3$ may also represent a group of non-metal atoms which forms a nitrogen-containing 5-membered ring or 6-membered ring together with $R_2$. $Y_1$ and $Y_2$ each represents a hydrogen atom or a group which is released upon coupling with the oxidized product of the developing agent. n represents 0 or 1.

The following are preferred as examples of cyan couplers represented by the above noted general formulae (C-I) or (C-II).

The preferred $R_1$ in general formula (C-I) is an aryl group or heterocyclic group, and further preference is given when $R_1$ is an aryl group substituted with a halogen atom, alkyl group, alkoxy group, aryloxy group, acylamino group, acyl group, carbamoyl group, sulfonamido group, sulfamoyl group, sulfonyl group, sulfamido group, oxycarbonyl group or a cyano group.

In general formula (C-I), when $R_3$ and $R_2$ do not form a ring, $R_2$ is preferably a substituted or unsubstituted alkyl group or aryl group, and particularly preferably an alkyl group substituted with a substituted aryloxy group, while $R_3$ is preferably a hydrogen atom.

The preferred $R_4$ in general formula (C-II) is a substituted or unsubstituted alkyl group or aryl group, and particularly preferably an alkyl group substituted with a substituted aryloxy group.

The preferred $R_5$ in general formula (C-II) is an alkyl group having 2–15 carbon atoms and a methyl group having a substituent group with one or more carbon atoms, preferable substituent groups being the arylthio group, alkylthio group, acylamino group, aryloxy group and alkyloxy group.

In general formula (C-II), $R_5$ is more preferably an alkyl group having 2–15 carbon atoms, and it is particularly preferably an alkyl group having 2–4 carbon atoms. In general formula (C-II), aliphatic groups are preferred for $R_5$, examples of which include a methyl group, ethyl group, propyl group, butyl group, pentadecyl group, tert-butyl group, cyclohexyl group, cyclohexylmethyl group, phenylthiomethyl group, dodecyl-oxyphenylthiomethyl group, butanamidomethyl group and methoxymethyl group.

The $R_6$ which is preferred in general formula (C-II) is a hydrogen atom or a halogen atom, and the chlorine atom and fluorine atom are particularly preferred.

The $Y_1$ and $Y_2$ which are preferred in general formulae (C-I) and (C-II) are respectively the hydrogen atom, halogen atom, alkoxy group, aryloxy group, acyloxy group and sulfonamido group.

In general formula (M-I), $R_7$ and $R_9$ each represents an aryl group, $R_8$ represents a hydrogen atom, aliphatic or aromatic acyl group or aliphatic or aromatic sulfonyl group, and $Y_3$ represents a hydrogen atom or a splitting group. Substituent groups for the aryl group (preferably the phenyl group) for $R_7$ and $R_9$ are the same as those for substituent group $R_1$ and, when there are 2 or more substituent groups, the substituent groups may be the same or different. $R_8$ is preferably a hydrogen atom, aliphatic acyl group or sulfonyl group, and it is particularly preferably a hydrogen atom. $Y_3$ is preferably a splitting group including a sulfur, oxygen or nitrogen atom and, by way of example, particular preference is given to the sulfur atom type splitting group described in U.S. Pat. No. 4,351,897 and International Disclosure WO 88/04795.

In general formula (M-II), $R_{10}$ represents a hydrogen atom or splitting group. $Y_4$ represents a hydrogen atom or splitting group, and particular preference is given to halogen atoms and the arylthio group. Za, Zb and Zc represent methine, substituted methine, =N— or —NH—, wherein one of the Za–Zb bond or Zb–Zc bond is a double bond and the other a single bond. When the Zb–Zc bond is a carbon-carbon double bond, this group may be part of an aromatic ring. In cases in which a dimer or higher polymer is formed by $R_{10}$ or $Y_4$, and when Za, Zb or Zc is a substituted methine, include cases in which a dimer or higher polymer is formed by the substituted methine.

Of the pyrazoloazole-based couplers represented by general formula (M-II), preference is given to the imidazo[1,2-b]pyrazoles described in U.S. Pat. No. 4,500,630, and particular preference is given to the pyrazolo[1,5-b][1,2,4] triazole described in U.S. Pat. No. 4,540,654 due to the small amount of yellow side absorption by the chromogenic dye, and due to the fastness to light.

In addition, preference is given to the use of the pyrazolotriazole coupler in which a branched alkyl group has been directly bonded to the 2-, 3- or 6-position of the pyrazolotriazole ring as described in JP-A-61-65245, the pyrazoloazole couplers which contain sulfonamido group as described in JP-A-61-65246, the pyrazoloazole couplers having alkoxyphenylsulfonamido ballast groups as described in JP-A-61-147254 and the pyrazolotriazole couplers having an alkoxy group or aryloxy group in the 6-position as described in European Patent Nos. (laid-open) 226,849 and 294,785.

In general formula (Y), $R_{11}$ represents a halogen atom, alkoxy group, trifluoromethyl group or aryl group, and $R_{12}$ represents a hydrogen atom, a halogen atom or alkoxy group. A represents $—NHCOR_{13}$, $—NHSO_2—R_{13}$, $—SO_2NHR_{13}$, $—COOR_{13}$ or

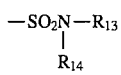

where $R_{13}$ and $R_{14}$ each represents an alkyl group, aryl group or acyl group. $Y_5$ represents a splitting group. The substituent groups for $R_{14}$, $R_{13}$ and $R_{12}$ are the same as those for $R_1$, and the splitting group $Y_5$ is preferably a splitting group including an oxygen atom or nitrogen atom, the nitrogen atom splitting type being particularly preferred.

Examples of the couplers represented by the general formulae (C-I), (C-II), (M-I), (M-II) and (Y) include the following compounds.

(C-1)
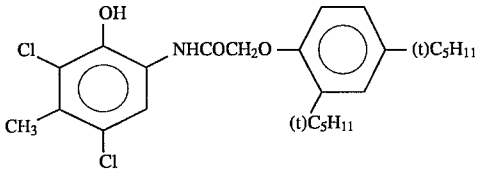
(C-2)
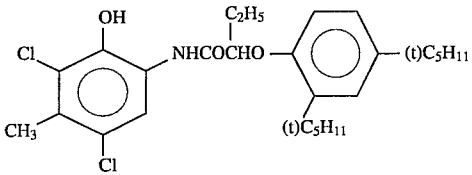
(C-3)
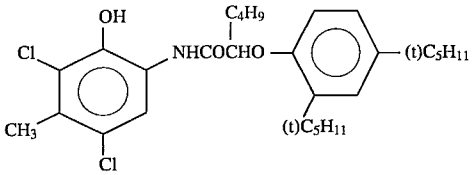
(C-4)
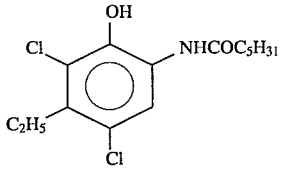
(C-5)
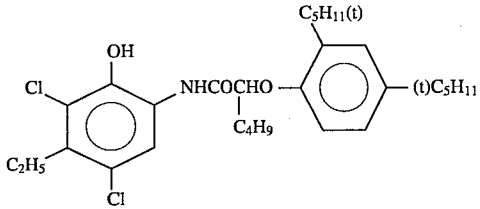

-continued
(C-6)
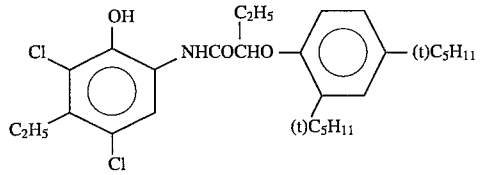
(C-7)
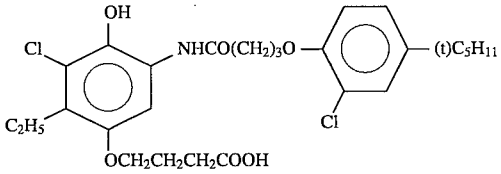
(C-8)
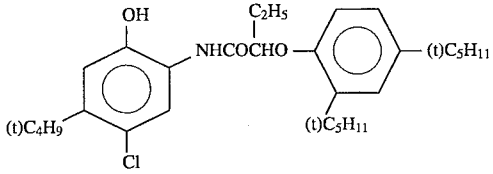
(C-9)
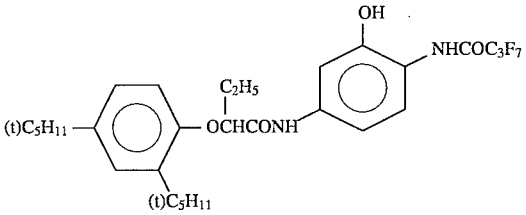
(C-10)
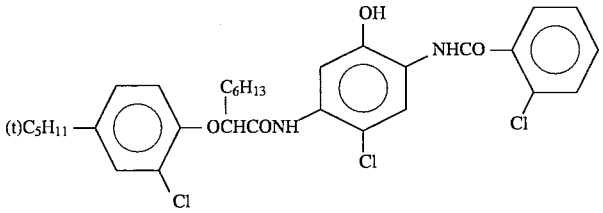

-continued
(C-11)
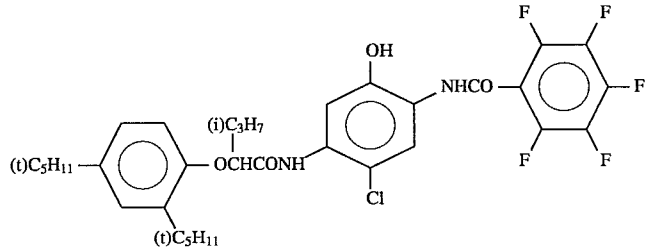
(C-12)
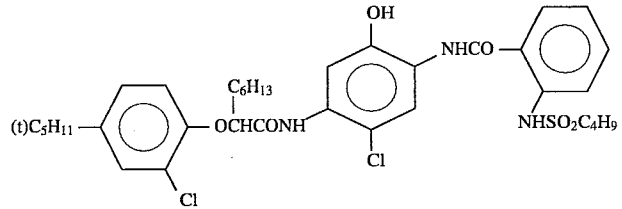
(C-13)
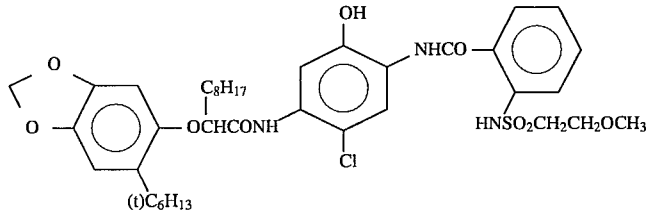
(C-14)
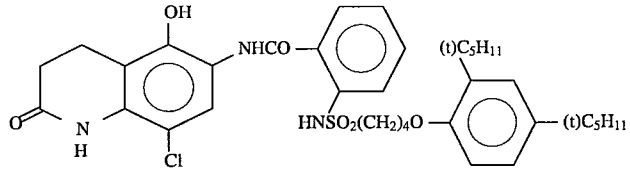
(C-15)
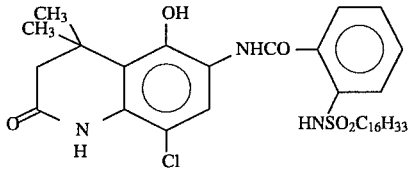

-continued
(C-16)
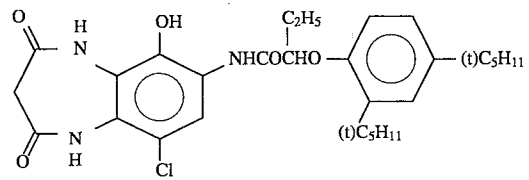
(C-17)
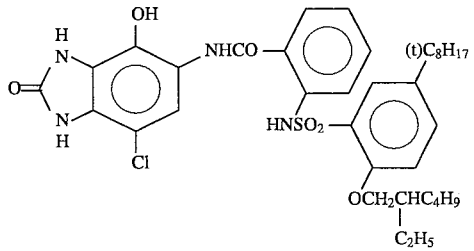
(C-18)
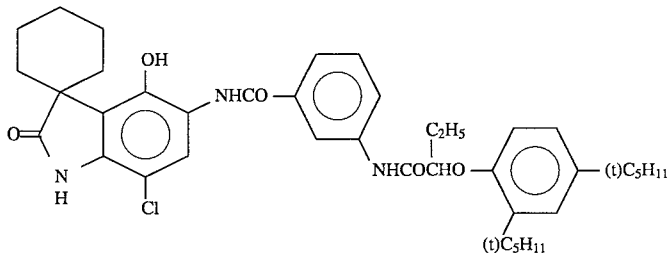
(C-19)
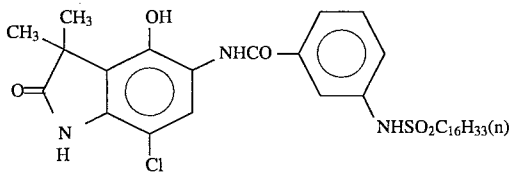
(C-20)
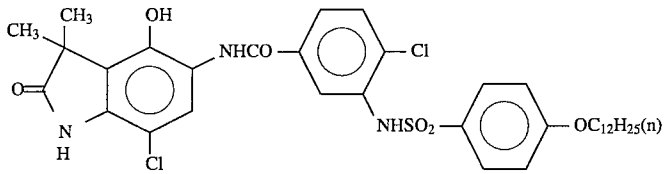

-continued
(C-21)
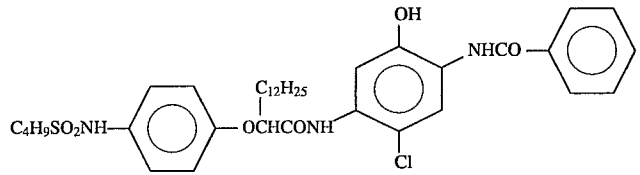
(C-22)
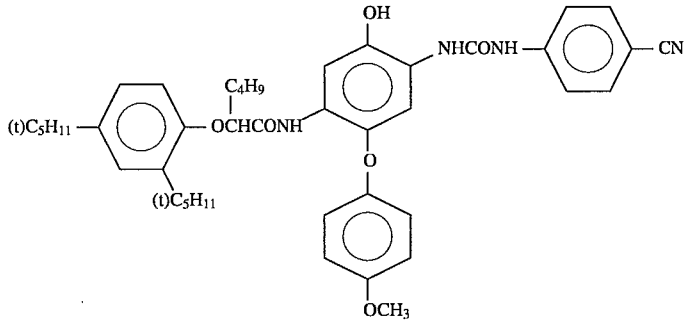
(M-1)
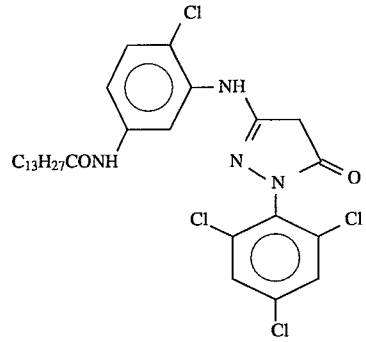

-continued
(M-2)
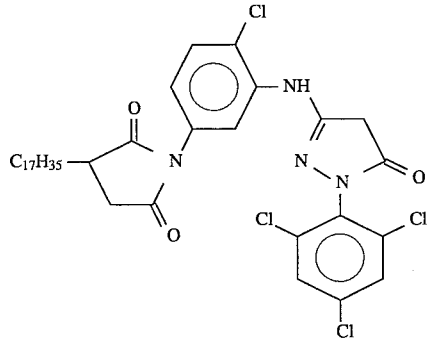
(M-3)
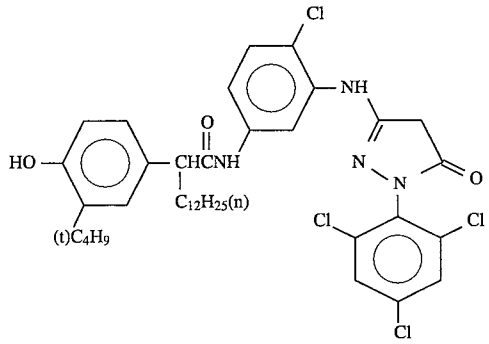
(M-4)
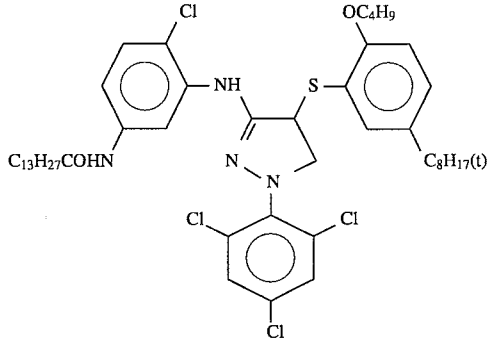

-continued
(M-5)
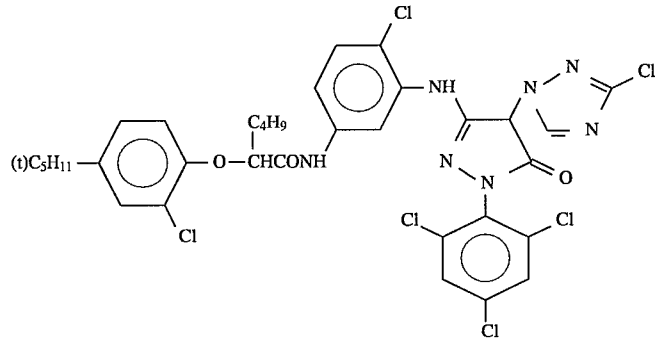
(M-6)
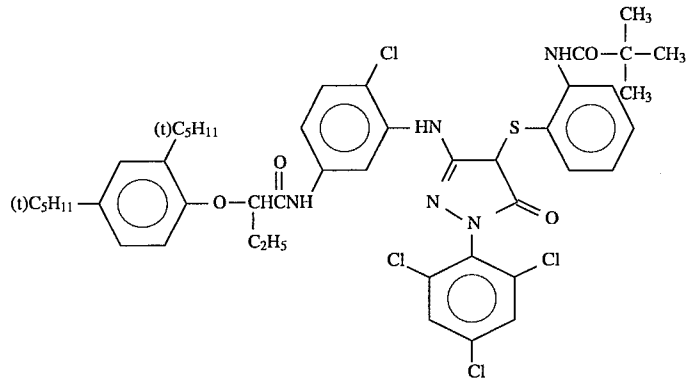
(M-7)
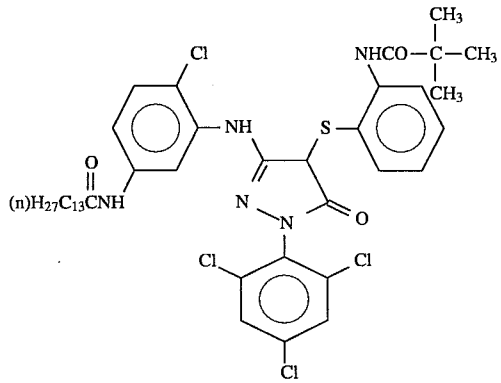

-continued
(M-8)
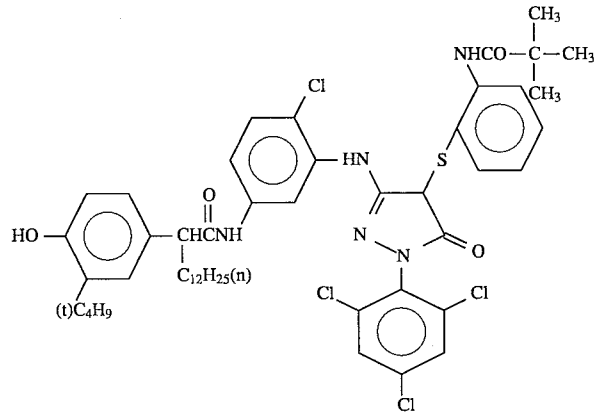
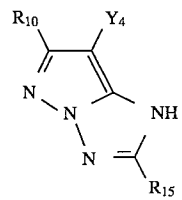
| Compound | $R_{10}$ | $R_{15}$ | $Y_4$ |
|---|---|---|---|
| M-9 | $CH_3-$ | 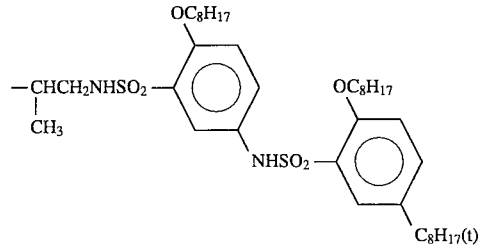 | Cl |
| M-10 | as above | 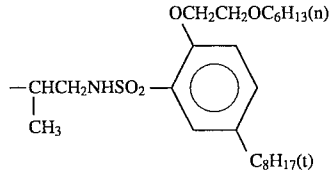 | as above |

-continued
| | | | |
|---|---|---|---|
| M-11 | $(CH_3)_3C-$ | 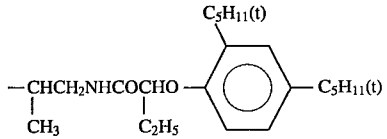 | 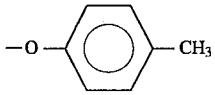 |
| M-12 | 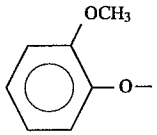 | 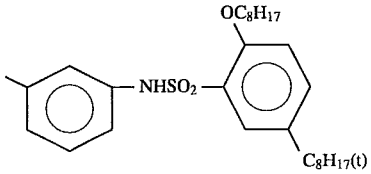 | 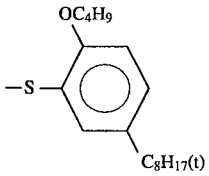 |
| M-13 | $CH_3-$ | 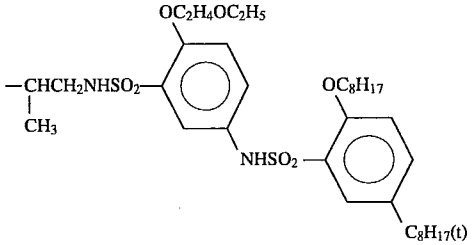 | Cl |
| M-14 | as above | 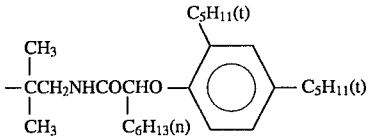 | as above |
| M-15 | $CH_3-$ | 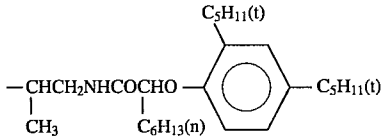 | Cl |
| M-16 | as above | 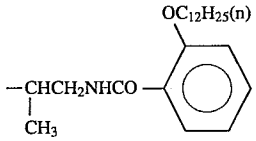 | as above |

-continued
| | | | |
|---|---|---|---|
| M-17 | as above | 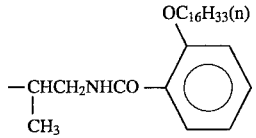 | as above |
| M-18 | 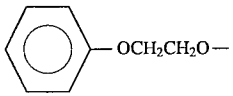 | 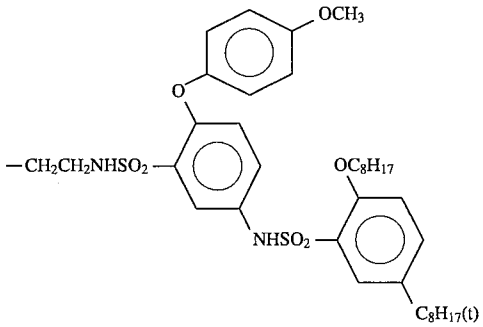 | 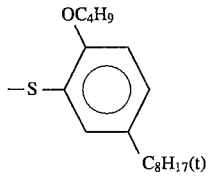 |
| M-19 | $CH_3CH_2O-$ | as above | as above |
| M-20 | 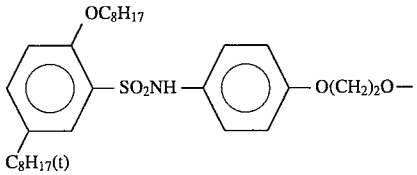 | 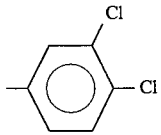 | 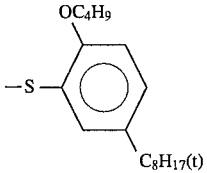 |
| M-21 | 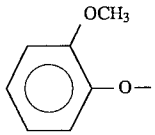 | 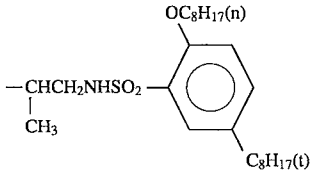 | Cl |
| M-22 | $CH_3-$ | 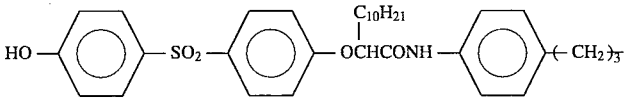 | Cl |
| M-23 | as above | 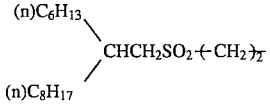 | as above |

-continued
| | | | |
|---|---|---|---|
| M-24 | 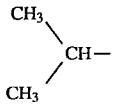 | 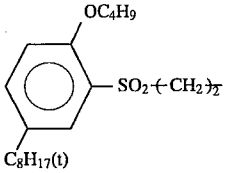 | as above |
| M-25 | 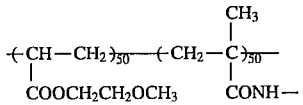 | 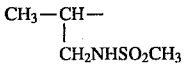 | as above |
| M-26 | 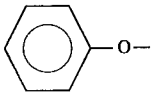 | 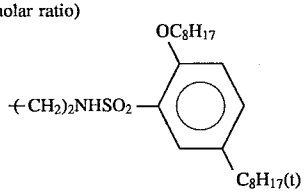 | Cl |
| M-27 | $CH_3-$ | 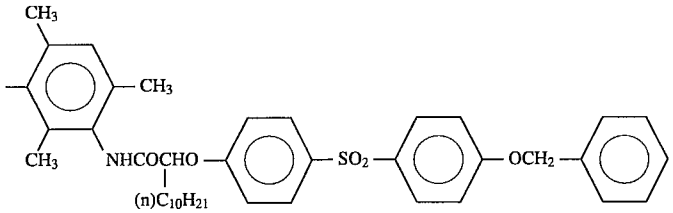 | as above |
| M-28 | $(CH_3)_3C-$ | 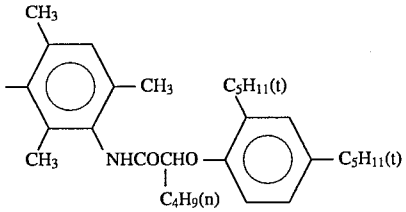 | as above |
| M-29 | 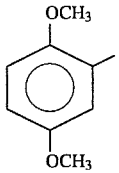 | 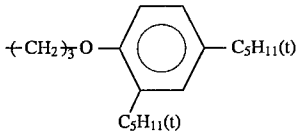 | Cl |
(Suffixes of parenthesis show molar ratio)

-continued
| | | | |
|---|---|---|---|
| M-30 | $CH_3-$ | $-CH(C_2H_5)-N(n)C_{18}H_{37}COCH_2CH_2COOH$ | as above |
(Y-1)
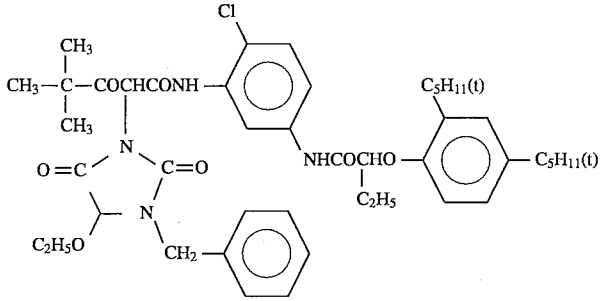
(Y-2)
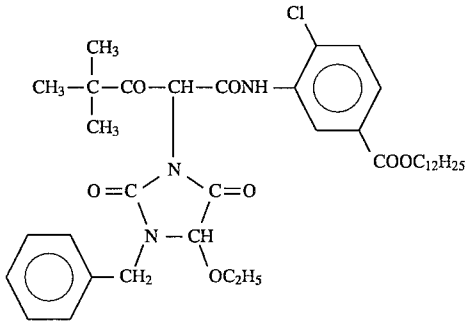

-continued
(Y-3)
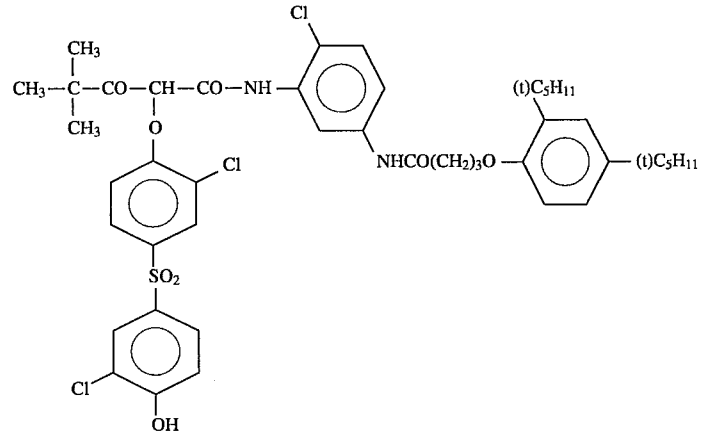
(Y-4)
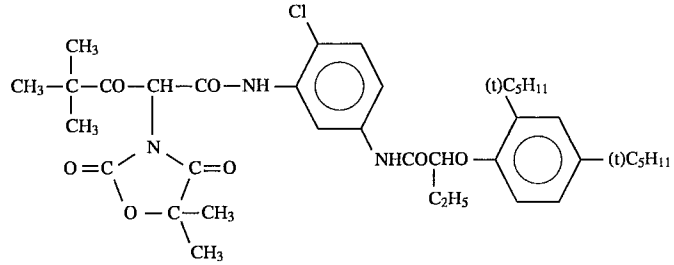
(Y-5)
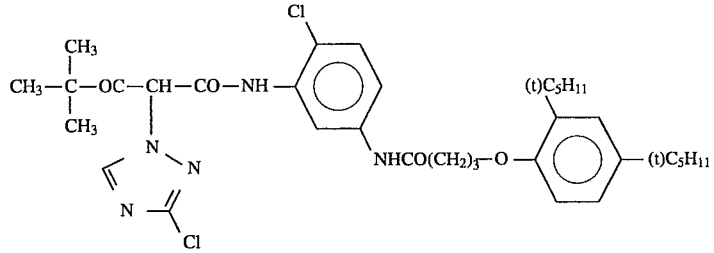

-continued
(Y-6)
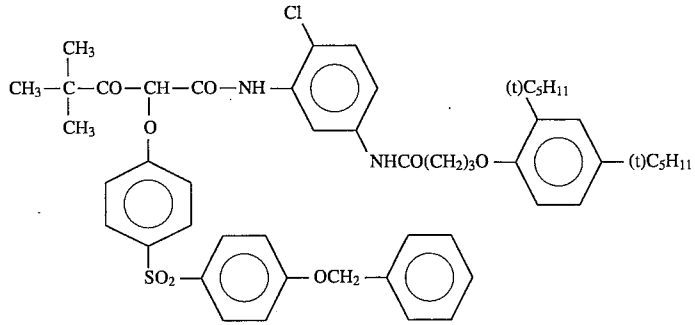
(Y-7)
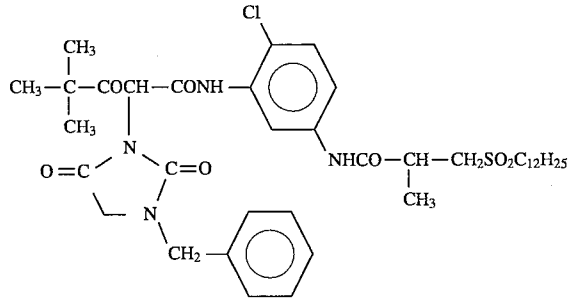
(Y-8)
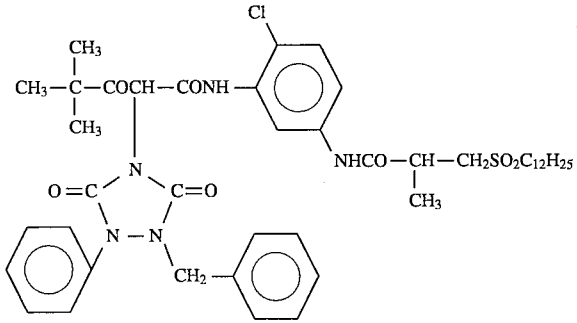

-continued
(Y-9)
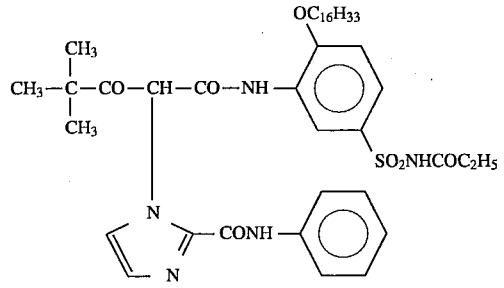

The couplers represented by the above formulas (C-I) to (Y) are generally used in an amount of 0.1 to 1.0 mol, and preferably from 0.1 to 0.5 mol per mol of silver halide in the silver halide emulsion constituting the sensitive layers of the present invention.

The couplers can be added to the sensitive layers by various conventional methods. Generally, the couplers can be added by the oil-in-water dispersion method known as oil protect method. The couplers are dissolved in a solvent and the resulting solution is emulsified and dispersed in an aqueous gelatin solution containing a surfactant. Alternatively, water or an aqueous gelatin solution is added to a coupler solution containing a surfactant, and an oil-in-water dispersion is formed by phase inversion. Alkali-soluble couplers can be dispersed by Fischer's dispersion method. After low-boiling organic solvents are removed from the coupler dispersion by distillation, noodle washing or ultrafiltration, the coupler dispersion may be mixed with the photographic emulsions.

High-boiling organic solvents having a dielectric constant (25° C.) of from 2 to 20 and a refractive index (25° C.) of 1.5 to 1.7 and/or water-insoluble high-molecular weight compounds are preferred as the dispersion medium for these couplers. Preferably, the high-boiling organic solvents represented by the following formulae (A) to (E) are used.

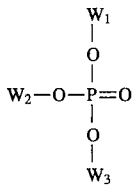

(A)

$W_1-COO-W_2$ (B)

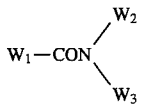

(C)

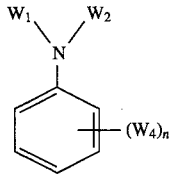

(D)

$W_1-O-W_2$ (E)

In the above formulae, $W_1$, $W_2$ and $W_3$ each represent a substituted or unsubstituted alkyl, cycloalkyl, alkenyl, aryl or heterocyclic group; $W_4$ is $W_1$, $OW_1$ or $SW_1$; and n is an integer of from 1 to 5. When n is 2 or more, the $W_4$ groups may be the same or different. In the formula (E), $W_1$ and $W_2$ may combine together to form a condensed ring.

In addition to the compounds of the formulae (A) to (E), water-immiscible compounds having a melting point of not higher than 100° C. and a boiling point of not lower than 140° C. can be used as the high-boiling organic solvent in the present invention, as long as the compounds are good solvents for the couplers. The high-boiling organic solvent preferably has a melting point not higher than 80° C. and a boiling point not lower than 160° C., and more preferably not lower than 170° C.

Useful high-boiling organic solvents are described in detail in the disclosure of JP-A-62-215272 (page 137, the lower light column to page 144, the upper right column).

Furthermore, these couplers can be impregnated into a loadable latex polymer (for example, U.S. Pat. No. 4,203,716) with or without the use of the aforementioned high boiling point organic solvents, or they can be dissolved in a water insoluble, organic solvent soluble polymer and emulsified and dispersed in an aqueous hydrophilic colloid solution.

Use of the homopolymers and copolymers disclosed on pages 12 to 30 of International Patent laid open WO88/00723 is preferred, and the use of acrylamide polymers is especially preferred from the point of view of colored image stabilization etc.

Photosensitive materials of the present invention may contain hydroquinone derivatives, aminophenol derivatives, gallic acid derivatives and ascorbic acid derivatives as anti-color fogging agents.

Various anti-color fading agents can be used in the photosensitive materials of the present invention. Hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines and ether and ester derivatives in which the phenolic hydroxyl groups of these compounds have been silylated or alkylated are typical organic anti-color fading agents which can be used for cyan, magenta and/or yellow images. Furthermore, metal complexes as typified by (bissalicylaldoximato)nickel and (bis-N,N-dialkyldithiocarbamato)nickel complexes, for example, can also be used for this purpose.

Actual examples of organic anti-color fading agents are disclosed in the patents indicated below.

Hydroquinones are disclosed, for example, in U.S. Pat. Nos. 2,360,290, 2,418,613, 2,700,453, 2,701,197, 2,728,659, 2,732,300, 2,735,765, 3,982,944 and 4,430,425, British Patent No. 1,363,921, and U.S. Pat. Nos. 2,710,801 and 2,816,028. 6-Hydroxychromans, 5-hydroxychromans and spirochromans are disclosed, for example, in U.S. Pat. Nos. 3,432,300, 3,573,050, 3,574,627, 3,698,909 and 3,764,337, and JP-A-52-152225. Spiroindanes have been disclosed in U.S. Pat. No. 4,360,589. P-alkoxyphenols are disclosed, for example, in U.S. Pat. No. 2,735,765, British Patent No. 2,066,975, JP-A-59-10539 and JP-B-57-19765. Hindered phenols are disclosed, for example, in U.S. Pat. No. 3,700,455, JP-A-52-72224, 4,228,235, and JP-B-52-6623. Gallic acid derivatives, methylenedioxybenzenes and aminophenols are disclosed, for example, in U.S. Pat. Nos. 3,457,079 and 4,332,886, and JP-B-56-21144 respectively. Hindered amines are disclosed, for example, in U.S. Pat. Nos. 3,336,135 and 4,268,593, British Patent Nos. 1,32,889, 1,354,313 and 1,410,846, JP-B-51-1420, JP-A-58-114036, JP-A-59-53846 and JP-A-59-78344, and metal complexes are disclosed, for example, in U.S. Pat. Nos. 4,050,938 and 4,241,155, and British Patent No. 2,027,731(A). These compounds can be used effectively by addition to the photosensitive layer after co-emulsification with the corresponding color coupler, usually at a rate of from 5 to 100 wt% with respect to the coupler. The inclusion of ultraviolet absorbers in the layers on both sides adjacent to the cyan color forming layer is effective for preventing degradation of the cyan dye image by heat, and especially by light.

Ultraviolet absorbers can be included in the hydrophilic colloid layers in the photosensitive materials of the present invention. For example, benzotriazole compounds substituted with aryl groups (for example, those disclosed in U.S. Pat. No. 3,533,794), 4-thiazolidone compounds (for example, those disclosed in U.S. Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,375), butadiene compounds (for example, those disclosed in U.S. Pat. No. 4,045,229), or benzoxadol compounds (for example, those disclosed in U.S. Pat. Nos. 3,406,070, 3,677,762 and 4,271,307) can be used for this purpose. Ultraviolet absorbing couplers (for example, α-naphthol based cyan dye forming couplers) and ultraviolet absorbing polymers, for example, can also be used for this purpose. These ultraviolet absorbers can be mordanted in a specified layer.

Among them, the afore-mentioned aryl group-substituted benztriazole compounds are preferred.

The compounds described below are preferably used together with the above-described couplers, particularly pyrazoloazole couplers.

Namely, a compound (F) and/or a compound (G) are used alone or in combination. The compound (F) is chemically bonded to the aromatic amine developing agent remaining after color development, to form a compound which is chemically inactive and substantially colorless. The compound (G) is chemically bonded to the oxidation product of the aromatic amine developing agent remaining after color development. For example, staining due to the formation of a color resulting from the reaction of the coupler with the remaining developing agent or oxidation product thereof in the film during storage after processing is prevented. Other undesirable side effects are also be prevented.

Compounds having a second-order reaction constant $k_2$ (in trioctyl phosphate at 80° C.) in terms of the reaction of p-anisidine of from 1.0 to $1\times10^{-5}$ l/mol•sec are preferred as the compound (F). The second-order reaction constant can be measured by the method described in JP-A-158545.

When $k_2$ is larger than the above upper limit, the compound becomes unstable and tends to react with gelatin or water. When $k_2$ is smaller than the above lower limit, the reaction rate of the compound with the remaining aromatic amine developing agent is reduced, and the side effect caused by the remaining aromatic amine developing agent is not fully prevented.

Compounds represented by the following formulae (FI) and (FII) are preferred as the compounds (F).

$$R_2-\underset{\underset{B}{|}}{C}=Y. \qquad \text{(FII)}$$

In the above formulae, $R_1$ and $R_2$ each represents an aliphatic group, an aromatic group or a heterocyclic group; n represents 0 or 1; A is a group which forms a chemical bond by the reaction with an aromatic amine developing agent; X is a group which is eliminated by the reaction with the aromatic amine developing agents; B represents a hydrogen atom, an aliphatic group, an aromatic group, a heterocyclic group, an acyl group or sulfonyl group; and Y represents a group which accelerates the addition of the aromatic amine developing agent to the compound having the formula (FII). $R_1$ and X, or Y and $R_2$ or B may combine together to form a ring.

Typical reactions for chemically bonding the remaining aromatic amine developing agent include a substitution reaction and an addition reaction.

Preferred examples of the compounds represented by the formulae (FI) and (FII) are described in JP-A-63-158545, JP-A-62-283338 and European Patent Laid-Open Nos. 298321 and 277589.

Compounds represented by the following formula (GI) are preferred as the compound (G) which chemically bonds to the oxidation product of the aromatic amine developing agent remaining after color development to form a chemically inactive and substantially colorless compound.

R—Z (GI)

In the above formula, R represents an aliphatic group, an aromatic group or a heterocyclic group; Z represents a nucleophilic group or a group which is decomposes in the photographic material to release a nucleophilic group. With regard to the compounds having the formula (GI), compounds where Z is a group having a Pearson's nucleophilic $^{n}CH_3I$ value [R. G Pearson, et al., *J. Am. Chem. Soc.*, 90 319 (1968)] of 5 or more or a group derived therefrom, are preferred.

Preferred examples of the compounds of the formula (GI) are described in European Patent Laid-Open No. 255722, JP-A-62-143048, JP-A-62-229145, Japanese Patent Application Nos. 63-136724 and 62-214681 and European Patent Laid-Open Nos. 298321 and 277589.

Combinations of the compounds (G) with the compounds (F) are described in more detail in European Patent Laid-Open No. 277589.

Colloidal silver and dyes can be used in the full color recording materials of the present invention for anti-irradiation purposes, for anti-halation purposes, and especially for separating the spectral sensitivity distributions of the photosensitive layers and ensuring safety under safelights in the visible wavelength region.

Usually, a dye for an anti-irradiation or anti-halation purposes is used for a yellow dye forming emulsion layer and/or a magenta dye forming emulsion layer. The dye is generally incorporated into a ultraviolet absorbing layer. A filter dye is used for a cyan dye forming emulsion layer.

For an anti-irradiation purpose, a dye having a spectral absorption within the range of the principal sensitivity wavelength of the emulsion layer is used. It is preferred that the dye is water soluble. The use of such a dye improve storage stability after exposure up to development.

For an anti-halation purpose, a dye having a spectral absorption within the range of the principal sensitivity wavelength of the emulsion layer is used. It is preferred that the dye is incorporated as a non-diffusible state in a specified layer.

As a filter dye, a dye having a maximum absorption wavelength outside the range of the principal sensitivity wavelength of the emulsion layer is used. The dye is incorporated as a nondiffusible state in a specific layer.

Oxonol dyes, hemi-oxonol dyes, styryl dyes, merocyanine dyes, cyanine dyes and azo dyes can all be used for this purpose. Of these, the oxonol dyes, hemioxonol dyes and the merocyanine dyes are especially useful.

The decolorizable dyes or dyes for backing layers disclosed, for example, in JP-A-62-3250, JP-A-62-181381, JP-A-62-123454 and JP-A-63-197947 (preferably dyes represented by formula (VI) or (VII)), and the dyes disclosed in JP-A-62-39682, JP-A-62-123192, JP-A-62-158779 and JP-A-62-174741, or dyes obtained by introducing water solubilizing groups into these dyes so that the dyes can be washed out during processing, can be used as red—infrared dyes. The infrared dyes used in the present invention may be colorless with essentially no absorption at all in the visible wavelength region.

There is a problem in that when the infrared dyes used in the present invention are mixed with a silver halide emulsion spectrally sensitized to the red— infrared region, desensitization or fogging may occur, and when the dyes themselves are adsorbed on the silver halide grains, weak and broad spectral sensitization occurs. Hence the inclusion of these dyes in just colloid layers other than the photosensitive layers is preferred. For this reason, the inclusion of dyes in a state in which they are fast to diffusion in a specified colored layer is preferred. First, the dyes can be rendered fast to diffusion by the introduction of ballast groups. However, this is liable to result in the occurrence of residual coloration and process staining. Second, anionic dyes can be mordanted by a polymer or polymer latex which provides cation sites. Third, dyes which are insoluble in water at pH levels below 7 and which are decolorized and washed out during processing can be used in the form of fine particle dispersions. In this case, the dyes can be dissolved in a low boiling point organic solvent or rendered soluble into a surfactant and the solution so obtained can be dispersed in a hydrophilic protective colloid, such as gelatin, for use. Most desirably, the solid dye is milled with an aqueous surfactant solution and formed into fine particles mechanically in a mill, and these fine particles are dispersed in an aqueous solution of a hydrophilic colloid, such as gelatin, for use.

Gelatin is useful as a binder or protective colloid to use in the photosensitive layers of the photosensitive materials of the present invention, but other hydrophilic colloids, either alone or in conjunction with gelatin, can be use for this purpose.

The gelatin used in the invention may be a lime treated or acid treated gelatin. Details of the preparation of gelatins have been disclosed by Arthur Weise in *The Macromolecular Chemistry of Gelatin* (published by Academic Press, 1964).

The color photographic materials of the present invention may contain conventional photographic additives and materials which are generally used in commercially available color paper comprising a high silver chloride content emulsion (grains have an average silver halide content of not lower than 96 mol%) in particular. The additives and the materials may be selected from those described in the following *Research Disclosure* (RD) publications.

| | Additives | RD 17643 | RD 18716 |
|---|---|---|---|
| 1. | Chemical Sensitizing Agent | Page 23 | Page 648, right column |
| 2. | Sensitivity Increasing Agent | - ditto - | - ditto - |
| 3. | Spectral Sensitizing Agent | Pages 23 to 24 | Page 648, right column to page 649, right column |
| 4. | Supersensitizing Agent | ditto | - ditto - |
| 5. | Brightening Agents | Page 24 | - ditto - |
| 6. | Anti-fogging Agent, Stabilizer | Pages 24 to 25 | Page 649, right column |
| 7. | Coupler | Page 25 | - ditto - |
| 8. | Organic Solvent | Page 25 | - ditto - |
| 9. | Light Absorbing Agent, Filter Dye | Page 25 to 26 | Page 649 right column to page 650 left column |
| 10. | Ultraviolet Light Absorber | ditto | - ditto - |
| 11. | Stain Inhibitor | Page 25 right col. | Page 650 left and right columns |
| 12. | Dye Image Stabilizer | Page 25 | - ditto - |
| 13. | Hardening Agent | Page 26 | Page 651 left column |
| 14. | Binder | Page 26 | - ditto - |
| 15. | Plasticizer, Lubricant | Page 27 | Page 650 right column |
| 16. | Coating Aid Surfactant | Pages 26 to 27 | - ditto |

-continued

| | Additives | RD 17643 | RD 18716 |
|---|---|---|---|
| 17. | Antistatic Agent | Page 27 | - ditto - |

The present invention is now illustrated in detail with the following nonlimiting Examples. In these Examples all parts, percentages and ratios are by weight unless otherwise indicated.

Example 1

A silver halide color photographic material as shown in Table 1 was prepared. This was taken to be Sample 1.

The silver halide emulsions described below were used for each layer.

Emulsion for the Cyan Coupler Containing Layer

Lime treated gelatin (30 grams) was added to 1000 ml of distilled water and dissolved at 40° C., after which the pH was adjusted to 3.8 with sulfuric acid; 5.5 grams of sodium chloride and 0.02 gram of N,N'-dimethylimidazolidin-2-thione were added and the temperature was raised to 52.5° C. A first solution obtained by dissolving 62.5 grams of silver nitrate in 750 ml of distilled water and a second solution obtained by dissolving 21.5 grams of sodium chloride in 500 ml of distilled water were added to and mixed with the gelatin solution over a period of 40 minutes while maintaining a temperature of 52.5° C. A third solution obtained by dissolving 62.5 grams of silver nitrate in 500 ml of distilled water and a fourth solution obtained by dissolving 21.5 grams of sodium chloride in 300 ml of distilled water were also added to the gelatin solution and mixed, over a period of 20 minutes at 52.5° C.

Exactly, $1\times10^{-8}$ mol/mol•Ag with respect to the total amount of silver halide of dipotassium hexachloroiridate was added to the gelatin solution during this addition and mixing process.

With an electron microscope, the resulting emulsion was observed to contain cubic grains having an average side length of about 0.46 μm and the variation coefficient of the grain size distribution had a value of 0.09.

After desalting and washing this emulsion with water, 0.2 gram of nucleic acid and a mono-disperse silver iodobromide emulsion of average grain size 0.05 μm (containing 15 mol% silver iodide and $1.2\times10^{-5}$ mol/mol•Ag of dipotassium hexachloroiridate) corresponding to 1.0 mol% as silver halide were added. The emulsion was then chemically sensitized with about $2\times10^{-6}$ mol/mol•Ag of triethylthiourea and the final emulsion prepared by adding $7\times10^{-6}$ mol/mol•Ag of compound (V-20), $7\times10^{-4}$ mol/mol-Ag of compound (I-1) and $5\times10^{-3}$ mol/mol•Ag of compound (F-1).

Emulsion for the Magenta Coupler Containing Layer

Lime treated gelatin (30 grams) was added to 1000 ml of distilled water and dissolved at 40° C., after which 5.5 grams of sodium chloride and 0.02 gram of N,N'-dimethyl-imidazolidin-2-thione were added and the temperature was raised to 50° C. A first solution obtained by dissolving 62.5 grams of silver nitrate in 750 ml of distilled water and a second solution obtained by dissolving 21.5 grams of sodium chloride in 500 ml of distilled water were added to and mixed with the gelatin solution over a period of 40 minutes while maintaining a temperature of 50° C. A third solution obtained by dissolving 62.5 grams of silver nitrate in 500 ml of distilled water and a fourth solution obtained by dissolving 21.5 grams of sodium chloride in 300 ml of distilled water were added to the gelatine solution and mixed, over a period of 20 minutes at 50° C.

Using an electron microscope, the resulting emulsion was observed to contain cubic grains having an average side length of about 0.44 μm and the variation coefficient of the grain size distribution had a value of 0.08.

After desalting and washing this emulsion with water, 0.2 gram of nucleic acid and a mono-disperse silver iodobromide emulsion of average grain size 0.05 μm (containing 30 mol% silver iodide and $2\times10^{-5}$ mol/mol•Ag of dipotassium hexachloroiridate) corresponding to 0.5 mol% as silver halide were added. The emulsion was then chemically sensitized with about $2.5\times10^{-6}$ mol/mol•Ag of triethylthiourea and the final emulsion was prepared by adding $1.1\times10^{-5}$ mol/mol•Ag of compound (V-5), $1.1\times10^{-3}$ mol/mol•Ag of compound (I-1) and $5\times10^{-3}$ mol/mol•Ag of compound (F-1).

Emulsion for the Yellow Coupler Containing Layer

An emulsion was prepared in the same way as the emulsion for the magenta coupler containing layer described above except that $1.2\times10^{-4}$ mol/mol-Ag and $0.2\times10^{-4}$ mol/mol•Ag respectively of compound (V-40) and compound (V-41) were added instead of compound (V-5); and no compound (F-1) was added.

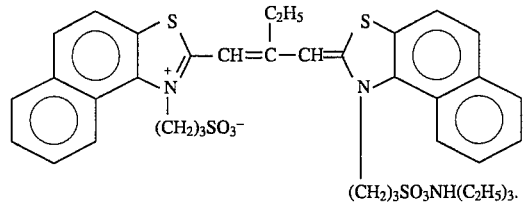

In order to improve safety under safe-lighting and to improve image sharpness, the compounds (D-1), (D-2), (D-3), (D-4), (D-5) and (D-6) were added to these emulsions in such a way that they were coated in amounts of 0.016 g/m², 0.006 g/m², 0.008 g/m², 0.013 g/m², 0.018 g/m², and 0.022 g/m² respectively.

TABLE 1

| Layer | Coated Material | | | Coated Weight |
|---|---|---|---|---|
| Ninth Layer (Protective Layer) | Gelatin | | | 1.00 g/m² |
| | Acrylic modified poly(vinyl alcohol) polymer (17% modification) | | | 0.12 g/m² |
| | Liquid Paraffin | | | 0.45 g/m² |
| Eighth Layer (Ultraviolet Absorbing Layer) | Gelatin | | | 0.65 g/m² |
| | Ultraviolet absorber | (X-1) | | 0.02 g/m² |
| | Ultraviolet absorber | (X-2) | | 0.09 g/m² |
| | Ultraviolet absorber | (X-3) | | 0.10 g/m² |
| | Anti-color mixing agent | (H-1) | | 0.02 g/m² |
| | Solvent | (S-5) | | 0.11 g/m² |
| Seventh Layer (Cyan Coupler Containing Layer) | The aforementioned emulsion for the cyan coupler containing layer | | (calculated as silver) | 0.24 g/m² |
| | Gelatin | | | 1.76 g/m² |
| | Polymer | (P-1) | | 0.53 g/m² |
| | Cyan coupler | (C-2) | | 0.07 g/m² |
| | Cyan coupler | (C-5) | | 0.12 g/m² |
| | Cyan coupler | (C-4) | | 0.09 g/m² |
| | Cyan coupler | (C-3) | | 0.07 g/m² |
| | Color image stabilizer | (X-1) | | 0.04 g/m² |
| | Color image stabilizer | (X-2) | | 0.05 g/m² |
| | Color image stabilizer | (X-4) | | 0.05 g/m² |
| | Color image stabilizer | (A-1) | | 0.01 g/m² |
| | Color image stabilizer | (B-1) | | 0.01 g/m² |
| | Color image stabilizer | (H-4) | | 0.01 g/m² |
| | Color image stabilizer | (H-2) | | 0.04 g/m² |
| | Solvent | (S-6) | | 0.11 g/m² |
| | Solvent | (S-7) | | 0.11 g/m² |
| Sixth Layer (Ultraviolet Absorbing Layer) | Gelatin | | | 1.60 g/m² |
| | Ultraviolet absorber | (X-1) | | 0.06 g/m² |
| | Ultraviolet absorber | (X-2) | | 0.27 g/m² |
| | Ultraviolet absorber | (X-3) | | 0.29 g/m² |
| | Anti-color mixing agent | (H-1) | | 0.06 g/m² |
| | Solvent | (S-5) | | 0.26 g/m² |
| Fifth Layer (Magenta Coupler Containing Layer) | The aforementioned emulsion for the magenta coupler containing layer | | (calculated as silver) | 0.15 g/m² |
| | Gelatin | | | 1.60 g/m² |
| | Magenta coupler | (M-13) | | 0.22 g/m² |
| | Magenta coupler | (M-10) | | 0.09 g/m² |
| | Color image stabilizer | (E-1) | | 0.10 g/m² |
| | Color image stabilizer | (A-1) | | 0.08 g/m² |
| | Color image stabilizer | (B-1) | | 0.03 g/m² |
| | Color image stabilizer | (H-3) | | 0.01 g/m² |
| | Solvent | (S-1) | | 0.44 g/m² |
| | Solvent | (S-3) | | 0.22 g/m² |

TABLE 1-continued

| Layer | Coated Material | | | Coated Weight |
|---|---|---|---|---|
| Fourth Layer (Anti-color Mixing) Layer) | Gelatin | | | 1.30 g/m$^2$ |
| | Anti-color mixing agent | (H-1) | | 0.06 g/m$^2$ |
| | Solvent | (S-3) | | 0.12 g/m$^2$ |
| | Solvent | (S-4) | | 0.12 g/m$^2$ |
| Third Layer (Yellow Coupler Containing Layer) | The aforementioned emulsion for the yellow coupler containing layer | | (calculated as silver) | 0.27 g/m$^2$ |
| | Gelatin | | | 1.66 g/m$^2$ |
| | Polymer | (P-1) | | 0.16 g/m$^2$ |
| | Yellow coupler | (Y-4) | | 0.14 g/m$^2$ |
| | Yellow coupler | (Y-3) | | 0.18 g/m$^2$ |
| | Yellow coupler | (Y-1) | | 0.35 g/m$^2$ |
| | Color image stabilizer | (H-4) | | 0.01 g/m$^2$ |
| | Solvent | (S-2) | | 0.15 g/m$^2$ |
| | Solvent | (S-6) | | 0.14 g/m$^2$ |
| Second Layer (Intermediate Layer) | Gelatin | | | 1.04 g/m$^2$ |
| | Anti-color mixing agent | (H-1) | | 0.05 g/m$^2$ |
| | Solvent | (S-3) | | 0.10 g/m$^2$ |
| | Solvent | (S-4) | | 0.10 g/m$^2$ |
| First Layer (Black Anti-halation Layer) | Black colloidal sliver | | (calculated as silver) | 0.04 g/m$^2$ |
| | Gelatin | | | 1.32 g/m$^2$ |
| | Ultraviolet absorber | (X-1) | | 0.02 g/m$^2$ |
| | Ultraviolet absorber | (X-2) | | 0.09 g/m$^2$ |
| | Ultraviolet absorber | (X-3) | | 0.10 g/m$^2$ |
| | Anti-color mixing agent | (H-1) | | 0.02 g/m$^2$ |
| | Solvent | (S-5) | | 0.11 g/m$^2$ |
| Support | Paper laminated with polyethylene containing 5 g/m$^2$ of $TiO_2$ | | | |

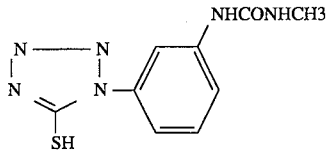

(I-1)

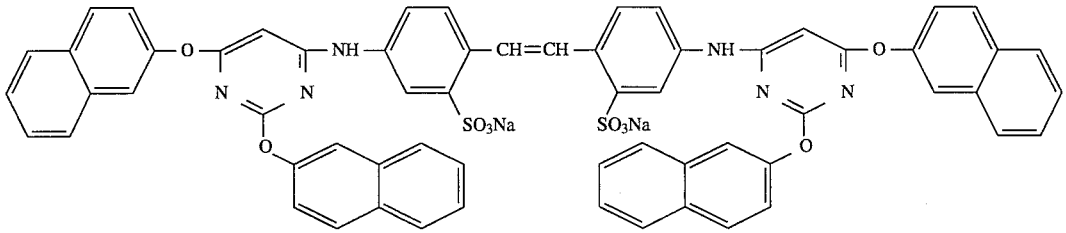

(F-1)

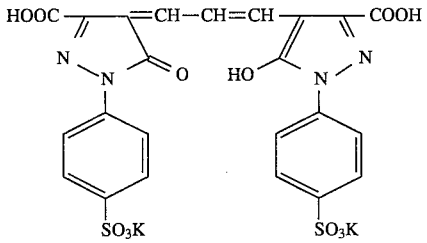

(D-1)

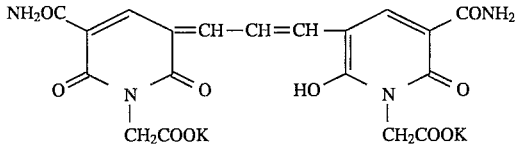

(D-2)

-continued
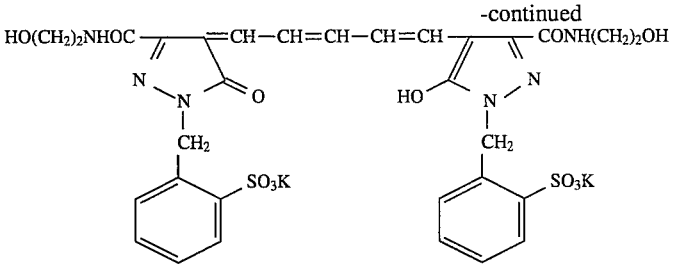
(D-3)
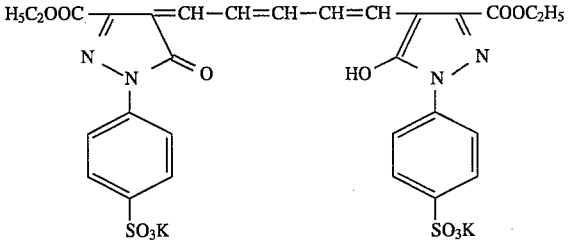
(D-4)
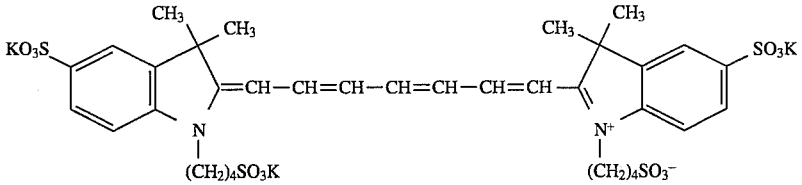
(D-5)
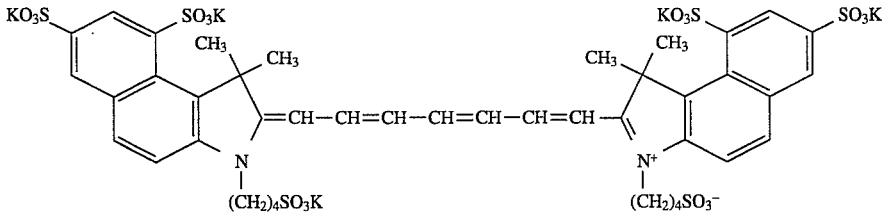
(D-6)
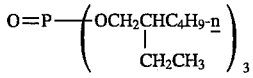
(S-1)
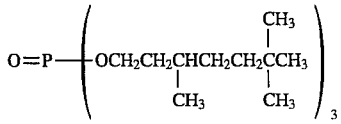
(S-2)
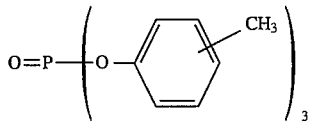
(S-3)
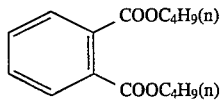
(S-4)
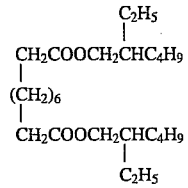
(S-5)

-continued
(S-6)
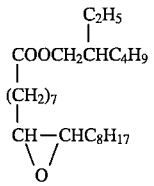
(S-7)
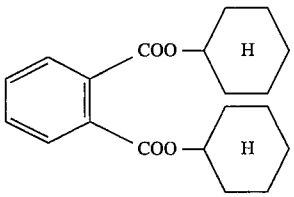
(H-1)
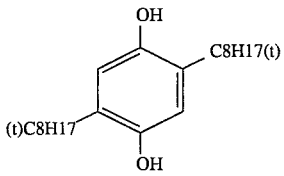
(H-2)
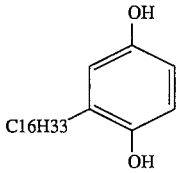
(H-3)
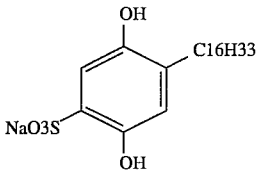
(H-4)
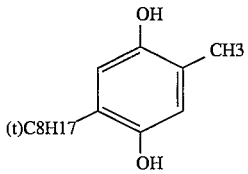
(X-1)
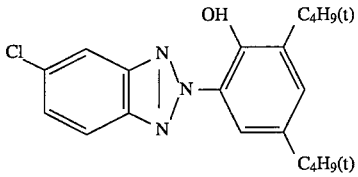
(X-2)
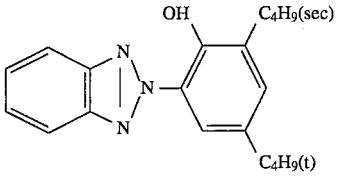
(X-3)
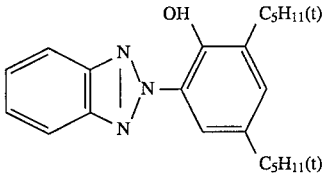

-continued (X-4)

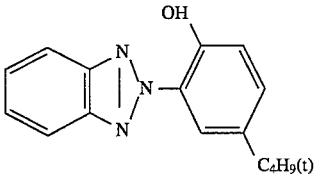

(A-1)

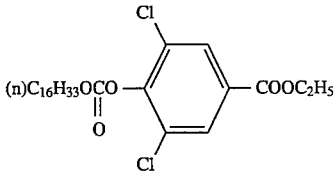

(B-1)

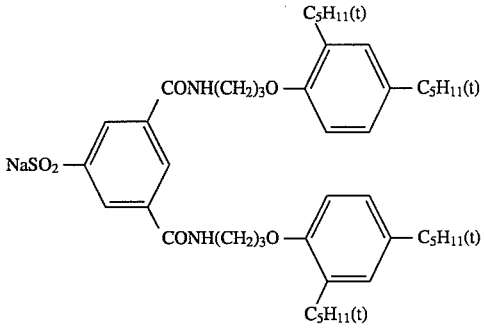

(P-1)

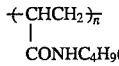

Molecular Weight about 60,000

(E-1)

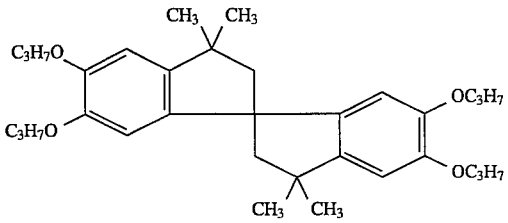

Furthermore, the three types of compound indicated below were used in a mol ratio of 3:2:1 as a gelatin hardening agent.

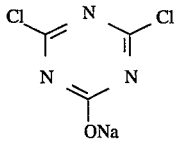

$CH_2NHCOCH_2SO_2CH{=}CH_2$
|
$CH_2NHCOCH_2SO_2CH{=}CH_2$ $OCH_2SO_2CH{=}CH_2$
|
$CH_2SO_2CH{=}CH_2$

Samples 2–4 were prepared in the same way as Sample 1 except that the halogen composition of the emulsions were changed as shown in Table 2.

TABLE 2

| Sample | Cyan Coupler Containing Layer | Magenta Coupler Containing Layer | Yellow Coupler Containing Layer | Remarks |
|---|---|---|---|---|
| 1 | 0.15 | 0.15 | 0.15 | Invention |
| | 0.85 | 0.35 | 0.35 | |
| 2 | 0.30 | 0.30 | 0.30 | Invention |
| | 0 | 0 | 0 | |
| 3 | 0 | 0 | 0 | Comp. Ex. |
| | 1.00 | 0.50 | 0.50 | |
| 4 | 0.30 | 0.30 | 0.30 | Comp. Ex. |
| | 0 | 0 | 0 | |

In this Table, the upper figures indicate the silver iodide content of each emulsion and the lower figures indicate the silver bromide content, in mol%. In emulsion 4 only, the silver iodide was included uniformly within the grains.

These Samples were subjected to a scanning exposure using a laser diode of emission wavelengths 670 nm, 750 nm, and 810 nm under temperature conditions of 25° C. and 35° C. at 400 dpi through an optical wedge with an average exposure time of $2\times10^{-7}$ second per picture element and, after 3 seconds, they were subjected to the Color Development Processing 1 described below.

| COLOR DEVELOPMENT PROCESSING 1 | | |
|---|---|---|
| Processing Operation | Temperature | Time |
| Color development | 50° C. | 9 seconds |
| Bleach-fix | 50° C. | 12 seconds |
| Rinse (1) | 40° C. | 5 seconds |
| Rinse (2) | 40° C. | 5 seconds |
| Rinse (3) | 40° C. | 5 seconds |
| Drying | 90° C. | 9 seconds |
| Color Developing Solution | | |
| Ethylenediamine-N,N,N',N'-tetra-methylenephosphonic acid | | 3.0 grams |
| N,N-Di(carboxmethyl)hydrazine | | 4.5 grams |
| N,N-Diethylhydroxylamine oxalate | | 2.0 grams |
| Triethanolamine | | 8.5 grams |
| Sodium sulfite | | 0.14 grams |
| Potassium chloride | | 1.6 grams |
| Potassium bromide | | 0.01 gram |
| Potassium carbonate | | 25.0 grams |
| N-Ethyl-N-(β-methanesulfonamidoethyl)-3-methyl-4-aminoaniline sulfate | | 5.0 grams |
| Whitex-4 (a whitner made by Sumitomo Chemicals) | | 1.4 grams |
| Water | | to make up to 1000 ml |
| pH | | adjusted to 10.05 |
| Bleach-fix Bath | | |
| Ammonium thiosulfate (55 wt. % aqueous solution) | | 100 ml |
| Sodium sulfite | | 17.0 grams |
| Ethylenediamine tetra-acetic acid, ferric ammonium salt | | 55.0 grams |
| Ethylenediamine tetra-acetic acid, di-sodium salt | | 5.0 grams |
| Ammonium bromide | | 40.0 grams |
| Glacial acetic acid | | 9.0 grams |
| Water | | to make up to 1000 ml |
| pH | | adjusted to 5.80 |

Rinse Bath

Ion exchanged water (Calcium less than 3 ppm, magnesium less than 2 ppm)

The cyan, magenta and yellow densities of the samples passed through Processing Operation 1 were measured using a TCD densitometer made by the Fuji Photographic Film Co. The speeds obtained are shown in Table 3. Speeds are indicated as relative values obtained by taking the speed of each colored layer in sample 1 exposed at 25° C. to be 100.

TABLE 3

| Exposure | Sample | Cyan Speed | Magenta Speed | Yellow Speed | Remarks |
|---|---|---|---|---|---|
| 25° C. | 1 | 100 | 100 | 100 | Invention |
| | 2 | 87 | 89 | 91 | Invention |
| | 3 | 79 | 79 | 81 | Comp. Ex. |
| | 4 | 32 | 31 | 31 | Comp. Ex. |
| 35° C. | 1 | 105 | 102 | 102 | Invention |
| | 2 | 91 | 93 | 96 | Invention |
| | 3 | 95 | 91 | 89 | Comp. Ex. |
| | 4 | 43 | 38 | 34 | Comp. Ex. |
| Exposure | 1 | 105 | 102 | 102 | Invention |
| Temp. | 2 | 105 | 104 | 105 | Invention |
| Dependence | 3 | 120 | 115 | 110 | Comp. Ex. |
| | 4 | 130 | 123 | 110 | Comp. Ex. |

In Table 3, the exposure temperature dependence is the ratio of the speed for each layer obtained on exposure at 35° C. with respect to the speed of each layer of each sample obtained on exposure at 25° C. expressed as a percentage.

Sample 1 of the present invention had a higher speed than Comparative Samples 3 and 4 when exposed at temperatures of 25° C. and 35° C. On the other hand, Sample 2 of the present invention had a higher speed than Comparative Samples 3 and 4 when exposed at 25° C. On exposure at 35° C., however, the cyan color forming emulsion layer of Sample 2 of the present invention was lower than that of the cyan color forming emulsion layer of Comparative Sample 3.

Sample 2 of the present invention was such that the difference between the speed on exposure at 35° C. and the speed on exposure at 25° C., was smaller than that for Comparative Sample 3, and especially in the case of the cyan color forming emulsion layer the difference was small. Similarly with Sample 1 of the present invention, the differences between the speeds on exposure at 35° C. and the speeds on exposure at 25° C. were small in comparison to those observed in Comparative Samples 3 and 4.

On the basis of the results described above, the present invention is useful for obtaining a stable speed even in cases where the temperature at which the photographic material is exposed varies, for example, as a result of changes in room temperature or from heat generated by the exposing equipment itself.

In the present invention, a high speed is obtained because silver iodide is included at the surface of the silver halide grains. The importance of the presence of silver iodide with respect to the effect of the exposure temperature can be seen by comparing the results obtained with Sample 2 of the present invention with those of Comparative Sample 4. The effect was pronounced in the cyan color forming layer in which a sensitizing dye, spectrally sensitized in the long wavelengths of the infrared region, had been used. This difference was greater than the one observed in the yellow colored layers in which sensitizing dyes that were spectrally sensitized in a comparatively short wavelength region had been used.

On the basis of the facts outlined above it is clear that samples in which emulsions of the present invention were used were excellent in terms of photographic speed and stability with respect to the exposing temperature, and at the same time, suitable for rapid processing.

Example 2

The Processing Operation 1 used in Example 1 was modified as indicated below to provide Processing Operation 2. Samples 1 and 3 used in Example 1 were processed using Processing Operation 2. The exposures were made in the same way as described in Example 1.

| Processing Operation | Temperature | Time |
|---|---|---|
| Color development | 35° C. | 45 seconds |
| Bleach-fix | 35° C. | 45 seconds |
| Rinse (1) | 25° C. | 30 seconds |
| Rinse (2) | 25° C. | 30 seconds |
| Rinse (3) | 25° C. | 30 seconds |
| Drying | 80° C. | 60 seconds |

In Processing Operation 1 the processing time was 45 seconds and an image was obtained very rapidly. In contrast, a period of 4 minutes was needed to obtain an image with Processing Operation 2. Similar results to those obtained in Example 1 were seen regarding the dependence of photographic speed on exposure temperature, but the difference in processing speed with the Comparative Sample was greater in Processing Operation 1 of Example 1, and the increase in speed in Processing Operation 2 was reduced from about 20% to 8% of that in Processing Operation 1.

This sample of the present invention had superior compatibility with rapid processing such as that of Processing Operation 1 and similar excellent features.

Example 3

A color development bath was prepared by changing the amount of N-ethyl-N-(β-methanesulfonamidoethyl)-3-methyl-4-aminoaniline sulfate in the color development solution of Processing Operation 1 used in Example 1 from 5 grams to 13 grams and by raising the adjusted pH from 10.05 to 11.2 with potassium hydroxide (for Processing Operation 3). Samples 1–4 used in Example 1 were processed at 50° C. for 5 seconds in this development solution. The bleach-fix and subsequent operations were the same as in Processing Operation 1.

The results obtained are shown in Table 4 displayed in the same way as they are displayed in Table 3.

TABLE 4

| Exposure | Sample | Cyan Speed | Magenta Speed | Yellow Speed | Remarks |
|---|---|---|---|---|---|
| 25° C. | 1 | 100 | 100 | 100 | Invention |
| | 2 | 91 | 91 | 93 | Invention |
| | 3 | 74 | 78 | 78 | Comp. Ex. |
| | 4 | 37 | 36 | 40 | Comp. Ex. |
| 35° C. | 1 | 102 | 100 | 102 | Invention |
| | 2 | 96 | 96 | 98 | Invention |
| | 3 | 89 | 90 | 83 | Comp. Ex. |
| | 4 | 47 | 43 | 43 | Comp. Ex. |

In this Example, processing was carried out even more rapidly than in Example 1. With both samples of the present invention the photographic speed was higher for all layers than for the Comparative Samples on exposure at both 25° C. and 35° C.; and the exposure temperature dependence was small. Samples and the method of image formation of the present invention were excellent.

Example 4

The processing solutions of Processing Operation 1 described in Example 1 were introduced into the equipment shown in FIG. 1, and Sample 1 was exposed and processed.

The processing times in each bath were modified slightly from Processing Operation 1 of Example 1 for convenience in using the equipment. However, these modifications were not significant.

In FIG. 1, the development tank 46 rack was set to the same length as the bleach-fix tank 48 rack and rinsing was carried out in two tanks instead of three. The line drive conditions were set in such a way that the processing time in each tank, including the crossover time, was about 9 seconds. Drying was carried out with a temporarily set drier in which the amount of air movement was greatly increased so that drying could be completed in the exhaust part.

With this equipment, the time elapsed after the scanning exposure before entering the color development solution was about 7 seconds; the time from entering into the color development solution to the end of rinsing was 36 seconds; and drying took about 14 seconds. Good color images were obtained in a total time of about 57 seconds.

Ten each of Samples 1 to 3 were exposed and processed at the rate of one every 30 minutes and the stability of the photographic speed in each case was investigated by means of the change in speed across the 10 exposures for each sample.

The change in speed with Sample 3 in the cyan color forming layer was 15%, while that of Sample 2 was within 7%, and that of Sample 1 was within 5%.

From the results above it is clear that rapid processing can be carried out using a machine such as shown in FIG. 1 using small amounts of liquid and that stable speed can be attained using the present invention.

Example 5

Emulsions were prepared along the lines described in Example 1, Samples 5 and 6 were prepared as shown in Table 5 and these were compared in the same way as described in Example 1.

TABLE 5

| Sample | Cyan Coupler Containing Layer | Magenta Coupler Containing Layer | Yellow Coupler Containing Layer | Remarks |
|---|---|---|---|---|
| 5 | 0.007 | 0.007 | 0.007 | Comp. Ex. |
| | 0.85 | 0.35 | 0.35 | |
| 6 | 3.3 | 3.3 | 3.3 | Comp. Ex. |
| | 0 | 0 | 0 | |

The numerical values displayed in this Table are the same as those in Table 2.

Sample 5 which contained silver iodide did not exhibit the benefical effects of the present invention. Sample 6 had a soft gradation and poor rapid processing compatibility. Both were inferior to the Samples of the present invention.

By means of the present invention it is possible to obtain stable photographic properties with high speed for laser exposure, to provide silver halide color photographic materials which are suitable for rapid processing and to provide a method of forming color images rapidly with a high photographic speed and in a stable manner.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising:

(a) support, (b) only three silver halide photosensitive emulsion layers comprising silver halide grains on said support, wherein (i) a first of said three photosensitive layers has a spectral sensitivity peak in the wavelength region of 650–690 nm; a second of said three photosensitive layers has a spectral sensitivity peak in the wavelength region of 720–790 nm; and a third of said three photosensitive layers has a spectral sensitivity peak in the wavelength region of 770–850 nm, at least two of said first, second and third photosensitive layers having been sensitized by at least one sensitizing dye selected from the group consisting of the dyes represented by general formula (I), (II) and (III), and

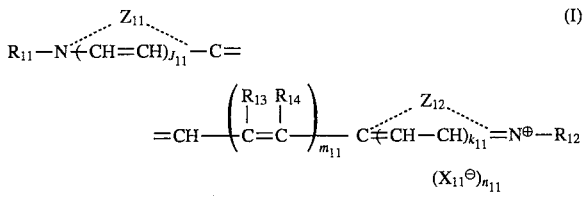

(I)

wherein $Z_{11}$ and $Z_{12}$ each represents a group of atoms which is required to form a heterocyclic ring; $R_{11}$ and $R_{12}$ each represents an alkyl group, an alkenyl group, an alkynyl group or an aralkyl group; $m_{11}$ represents an integer of 2 or 3; $R_{13}$ represents a hydrogen atom; $R_{14}$ represents a hydrogen atom, an alkyl group having one to four carbon atoms or an aralkyl group, or it is optionally joined with $R_{12}$ to form a 5- or 6-membered ring; $j_{11}$ and $k_{11}$ represent 0 or 1 $X^{\ominus}_{11}$ represents an acid anion, and $n_{11}$ represents 0 or 1;

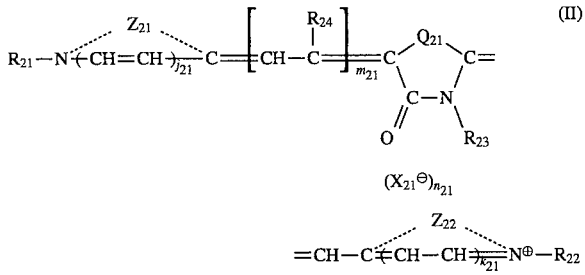

(II)

wherein $Z_{21}$ and $Z_{22}$ have the same definition as $Z_{11}$ and $Z_{12}$, respectively; $R_1$ and $R_{22}$ have the same definition as $R_{11}$ and $R_{12}$, respectively; $R_{23}$ represents an alkyl group, an alkenyl group, an alkynyl group or an aryl group; $m_{21}$ represents an integer of 2 or 3; $R_{24}$ represents a hydrogen atom, an alkyl group having one to four carbon atoms or an aryl group or $R_{24}$ is optionally joined with another $R_{24}$ group to form a hydrocarbyl or heterocyclic ring; $Q_{21}$ represents a sulfur atom, an oxygen atom, a selenium atom or an

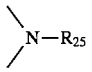

group, and $R_{25}$ has the same meaning as $R_{23}$; $j_{21}$, $k_{21}$, $X_{21}^{\ominus}$ and $n_{21}$ have the same definition as $j_{11}$ $k_{11}$ $x_{11}^{\ominus}$ and $n_{11}$, respectively;

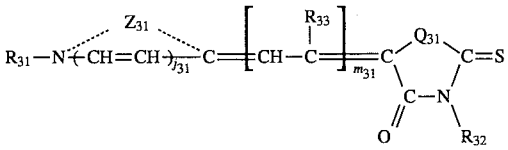

(III)

wherein $Z_{31}$ represents a group of atoms which is required to form a heterocyclic ring; $Q_{31}$ has the same definition as $Q_{21}$; $R_{31}$ has the same meaning as $R_{11}$ or $R_{12}$; $R_{32}$ has the same definition as $R_{23}$; $m_{31}$ represents 2 or 3; $R_{33}$ has the same definition as $R_{24}$, or it is optionally joined with another $R_{33}$ group to form a hydrocarbyl or heterocyclic ring; $j_{31}$ has the same definition as $j_{11}$;

(ii) one of said three photosensitive layers contains a cyan coupler, another of said three photosensitive layers contains a magenta coupler and another of said three photosensitive layers contains a yellow coupler, and (iii) said silver halide grains of said three photosensitive emulsion layers comprise silver halide composed of at least 96 mol% silver chloride and wherein said silver halide grains of at least one of said three layers have a local phase on the surface thereof containing from 0.01 to 3 mol% of silver iodide (based on the amount of silver halide in the emulsion), wherein the local phase containing the silver iodide is formed by recrystallization by mixing preformed silver halide grains and silver halide grains which have a different halogen composition from that of the silver halide which has been formed already, and then ripening the mixture.

2. The silver halide color photographic material as claimed in claim 1, wherein the silver halide grains in the third of said three photosensitive layers are said silver halide grains having a local phase on the surface thereof.

3. The silver halide color photographic material as claimed in claim 1, wherein the silver halide grains in all of said three photosensitive layers are said silver halide grains having a local phase on the surface thereof.

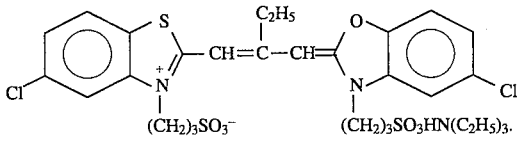

4. The silver halide color photographic material as claimed in claim 1, wherein the amount of silver iodide in the local phase is from 0.015 to 2 mol%.

5. The silver halide color photographic material as claimed in claim 4, wherein the amount of silver iodide in the local phase is from 0.02 to 1 mol%.

6. The silver halide color photographic material as claimed in claim 5, wherein the amount of silver iodide in the local phase is from 0.03 to 0.6 mol%.

7. The silver halide color photographic material as claimed in claim 1, wherein said silver halide grains having a local phase on the surface thereof contain iridium ions in the local phase.

* * * * *